US011244591B2

(12) United States Patent
Yu et al.

(10) Patent No.: US 11,244,591 B2
(45) Date of Patent: Feb. 8, 2022

(54) GAMMA CORRECTION METHOD, GAMMA CORRECTION DEVICE AND GAMMA CORRECTION SYSTEM

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Yong Yu, Beijing (CN); Chang Zhang, Beijing (CN); Renjie Ding, Beijing (CN); Chuanyan Lan, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/976,698

(22) PCT Filed: Sep. 26, 2019

(86) PCT No.: PCT/CN2019/108082
§ 371 (c)(1),
(2) Date: Aug. 28, 2020

(87) PCT Pub. No.: WO2021/056315
PCT Pub. Date: Apr. 1, 2021

(65) Prior Publication Data
US 2021/0097920 A1 Apr. 1, 2021

(51) Int. Cl.
*G09G 3/20* (2006.01)
*G09G 3/3208* (2016.01)

(52) U.S. Cl.
CPC ..... *G09G 3/2003* (2013.01); *G09G 3/2007* (2013.01); *G09G 3/3208* (2013.01); *G09G 2320/0242* (2013.01); *G09G 2320/0626* (2013.01); *G09G 2320/0673* (2013.01); *G09G 2360/145* (2013.01)

(58) Field of Classification Search
CPC ... G09G 2320/0242; G09G 2320/0626; G09G 2320/0673; G09G 2360/145; G09G 3/2003; G09G 3/2007; G09G 3/3208; G09G 2320/0693; G09G 5/10
See application file for complete search history.

(56) References Cited

U.S. PATENT DOCUMENTS

2010/0225663 A1* 9/2010 Lee ..... G09G 3/2003 345/596
2019/0051235 A1* 2/2019 Zhang ..... H04N 1/60
2021/0049966 A1* 2/2021 Hsu ..... G09G 3/3258

* cited by examiner

*Primary Examiner* — Kenneth Bukowski
(74) *Attorney, Agent, or Firm* — Procopio, Cory, Hargreaves & Savitch, LLP

(57) ABSTRACT

A gamma correction method applied to a display screen to be debugged includes: for a color of the display screen to be debugged, arranging a plurality of reference points, arranging at least one transition point between two adjacent reference points, and obtaining a brightness adjustment curve representing a corresponding relationship between a brightness adjustment value and a gamma band according to the plurality of reference points and the at least one transition point. Each gamma band represents a set of register values corresponding to gray scales of the color at the brightness adjustment value corresponding to the gamma band.

18 Claims, 11 Drawing Sheets

GAMMA CORRECTION METHOD, GAMMA CORRECTION DEVICE AND GAMMA CORRECTION SYSTEM

CROSS-REFERENCE TO RELATED APPLICATION

This application is a national phase entry under 35 USC 371 of International Patent Application No. PCT/CN2019/108082 filed on Sep. 26, 2019, which is incorporated herein by reference in its entirety.

TECHNICAL FIELD

The present disclosure relates to the field of display technologies, and in particular, to a gamma correction method, a gamma correction device, a gamma correction system, a computer-readable storage medium, and a computer program product.

BACKGROUND

In the field of display technologies, organic light-emitting diode (OLED) display devices have characteristics such as self-illumination, a wide viewing angle, fast response, and are widely used. In order to make display effects of the OLED display device meet visual perception of human eyes, there is a need to perform gamma correction (also called gamma tuning) on the OLED display device.

SUMMARY

In a first aspect, a gamma correction method is provided. The gamma correction method is applied to a display screen to be debugged, and includes: for a color of the display screen to be debugged, arranging a plurality of reference points, arranging at least one transition point between two adjacent reference points, and obtaining a brightness adjustment curve representing a corresponding relationship between brightness adjustment values and gamma bands according to the plurality of reference points and the at least one transition point. Each of the plurality of reference points represents a mapping relationship between a reference brightness adjustment value and a reference gamma band. The plurality of reference points are ranked in an order of the reference brightness adjustment values from small to large or from large to small. Each of the at least one transition point represents a mapping relationship between a transition brightness adjustment value and a transition gamma band. Each gamma band represents a set of register values corresponding to gray scales of the color at a brightness adjustment value corresponding to the gamma band.

In some embodiments, the step of arranging at least one transition point between two adjacent reference points includes: selecting at least one brightness adjustment value in a range between reference brightness adjustment values corresponding to the two adjacent reference points as at least one transition brightness adjustment value corresponding to the at least one transition point to be arranged; and, according to at least one of the two adjacent reference points, a debugging parameter group corresponding to each reference point of the plurality of reference points and a debugging parameter group corresponding to each transition point of the at least one transition point, sequentially calculating the transition gamma band corresponding to each transition brightness adjustment value of the at least one transition brightness adjustment value to obtain the at least one transition point. Each debugging parameter group represents a set of debugging parameters of register values corresponding to the gray scales of the color at the brightness adjustment value corresponding to a point in correspondence with the debugging parameter group.

In some embodiments, the step of according to at least one of the two adjacent reference points, a debugging parameter group corresponding to each of the plurality of reference points and a debugging parameter group corresponding to each of the at least one transition point, sequentially calculating the transition gamma band corresponding to each of the at least one transition brightness adjustment value to obtain the at least one transition point, includes: according to an order of the transition brightness adjustment values from small to large, sequentially calculating the transition gamma band corresponding to each of the at least one transition brightness adjustment value; and, for each transition brightness adjustment value, determining a point corresponding to a brightness adjustment value that is adjacent to the transition brightness adjustment value and less than the transition brightness adjustment value; according to a corresponding relationship between the point and a debugging parameter, finding out the debugging parameter group corresponding to the determined point; and calculating the transition gamma band corresponding to the transition brightness adjustment value according to a gamma band corresponding to the determined point and a debugging parameter group corresponding to the determined point, so as to obtain the transition point corresponding to the transition brightness adjustment value.

In some embodiments, the step of according to at least one of the two adjacent reference points, a debugging parameter group corresponding to each of the plurality of reference points and a debugging parameter group corresponding to each of the at least one transition point, sequentially calculating the transition gamma band corresponding to each of the at least one transition brightness adjustment value to obtain the at least one transition point, includes: according to an order of the transition brightness adjustment values from large to small, sequentially calculating the transition gamma band corresponding to each transition brightness adjustment value of the at least one transition brightness adjustment value; and, for each transition brightness adjustment value, determining a point corresponding to a brightness adjustment value that is adjacent to the transition brightness adjustment value and greater than the transition brightness adjustment value; according to a corresponding relationship between the point and a debugging parameter, finding out the debugging parameter group corresponding to the determined point; and calculating the transition gamma band corresponding to the transition brightness adjustment value according to a gamma band corresponding to the determined point and a debugging parameter group corresponding to the determined point, so as to obtain the transition point corresponding to the transition brightness adjustment value.

In some embodiments, the debugging parameter group corresponding to the determined point includes debugging parameters of the register values corresponding to the gray scales of the color, and a debugging parameter includes a coefficient a and a gain b of a register value corresponding to the debugging parameter. The step of calculating the transition gamma band corresponding to the transition brightness adjustment value according to a gamma band corresponding to the determined point and a debugging parameter group corresponding to the determined point, includes: finding a register value $X_i$ corresponding to an $i^{th}$ gray scale from the gamma band corresponding to the determined point; finding a debugging parameter ($a_i$, $b_i$) of the register value $X_i$ corresponding to the $i^{th}$ gray scale from the debugging parameter group corresponding to the determined point; calculating a register value $X'_i$ corresponding to the $i^{th}$ gray scale at the transition brightness adjustment value according to an equation $X'_i=a_i \times X_i+b_i$; and denoting that i is equal to 1 to n, by repeating the above steps, sequentially calculating register values $X'_1$ to $X'_n$ corresponding to n gray scales at the transition brightness adjustment value to obtain the transition gamma band corresponding to the transition brightness adjustment value; where n represents a number of gray scales of the color.

In some embodiments, the gamma correction method further includes a step of obtaining the debugging parameter group corresponding to each reference point of the plurality of reference points and the debugging parameter group corresponding to each transition point of the at least one transition point. This step includes: selecting a sample display screen; with reference to the plurality of reference points to be arranged in the display screen to be debugged, arranging a plurality of first points in the sample display screen; a gamma band corresponding to each of the plurality of first points being a set of register values obtained by performing gamma correction on register values corresponding to the gray scales of the sample display screen at a brightness adjustment value corresponding to the gamma band; with reference to the at least one transition point to be arranged in the display screen to be debugged, arranging a plurality of second points in the sample display screen; a gamma band corresponding to each of the plurality of second points being a set of register values obtained by performing gamma correction on register values corresponding to the gray scales of the sample display screen at a brightness adjustment value corresponding to the gamma band; according to the plurality of first points and the plurality of second points, sequentially calculating debugging parameters of register values corresponding to the gray scales at a brightness adjustment value corresponding to at least one specific point of the plurality of first points and the plurality of second points, so as to obtain a debugging parameter group corresponding to each specific point; and according to the debugging parameter group corresponding to each specific point, obtaining the debugging parameter group corresponding to each reference point of the plurality of reference points to be arranged in the display screen to be debugged, and obtaining the debugging parameter group corresponding to each transition point of the at least one transition point to be arranged in the display screen to be debugged. A plurality of brightness adjustment values corresponding to the plurality of first points are equal to the reference brightness adjustment values corresponding to the plurality of reference points in a one-to-one correspondence. A plurality of brightness adjustment values corresponding to the plurality of second points are equal to at least one transition brightness adjustment value corresponding to the at least one transition point in a one-to-one correspondence. The at least one specific point is a point adjacent to each second point and located before the corresponding second point according to an arrangement order of the brightness adjustment values. The arrangement order of the brightness adjustment values is an order of the brightness adjustment values from small to large, or an order of the brightness adjustment values from large to small.

In some embodiments, the step of according to the plurality of first points and the plurality of second points, sequentially calculating debugging parameters of register values corresponding to the gray scales at a brightness adjustment value corresponding to at least one specific point of the plurality of first points and the plurality of second points, includes: for each second point, determining a point that is adjacent to the second point and located before the second point according to the arrangement order of the brightness adjustment values as a specific point; and calculating debugging parameters corresponding to the gray scales of the specific point according to an equation $X'_{0i}=a_i \times X_{0i}+b_i$. $X'_{0i}$ represents a register value corresponding to an $i^{th}$ gray scale of the second point; $X_{0i}$ represents a register value corresponding to an $i^{th}$ gray scale of the specific point; $a_i$ represents a coefficient corresponding to the $i^{th}$ gray scale of the specific point, and $b_i$ represents a gain corresponding to the $i^{th}$ gray scale of the specific point.

In some embodiments, the gamma correction method further includes: prestoring the obtained debugging parameter group corresponding to each of the plurality of reference points and the obtained debugging parameter group corresponding to each of the at least one transition point into the display screen to be debugged.

In some embodiments, the selected sample display screen and the display screen to be debugged are display screens in a same production batch.

In some embodiments, reference brightness adjustment values corresponding to the two adjacent reference points and at least one transition brightness adjustment value corresponding to the at least one transition point form an arithmetic progression.

In some embodiments, the number of transition points disposed between two adjacent reference points is at least two.

In some embodiments, the step of arranging at least one transition point between two adjacent reference points includes: arranging at least one transition point between every two adjacent reference points.

In some embodiments, among a plurality of reference brightness adjustment values corresponding to the plurality of reference points, a brightness value adjustment range is determined according to a smallest reference brightness adjustment value and a largest reference brightness adjustment value. The brightness value adjustment range includes a first section and a second section, and a brightness adjustment upper limit value of the first section is not greater than a brightness adjustment lower limit value of the second section. The number of transition points corresponding to the first section is greater than the number of transition points corresponding to the second section.

In some embodiments, the number of transition points arranged between every two adjacent reference points in the first section is greater than the number of transition points arranged between every two adjacent reference points in the second section.

In some embodiments, the step of arranging a plurality of reference points includes: selecting a plurality of brightness adjustment values as a plurality of reference brightness adjustment values corresponding to the plurality of reference points to be arranged; and performing gamma correction on register values of gray scales of the display screen to be debugged at each selected reference brightness adjustment value, so as to obtain the reference gamma band in correspondence with the corresponding reference brightness adjustment value.

In some embodiments, the display screen to be debugged is able to display at least two colors. For an establishment of the brightness adjustment curve of each color, the gamma correction method as described above is performed.

In a second aspect, a gamma correction device is provided. The gamma correction device includes a memory and a processor. The memory stores a computer instruction, and the processor is configured to read and execute the computer instruction, so as to achieve one or more steps in the gamma correction method as described in any one embodiment in the first aspect.

In a third aspect, a gamma correction system is provided. The gamma correction system includes the gamma correction device as described in the second aspect, a driving device, and an optical testing device. The driving device is configured to drive a display screen to be debugged to operate. The optical testing device is configured to sample optical parameters of the display screen to be debugged under the control of the gamma correction device, and upload the sampled optical parameters to the gamma correction device.

In a four aspect, a non-transitory computer-readable storage medium is provided. The non-transitory computer-readable storage medium stores a computer instruction capable of being run on a processor, and the computer instruction, when executed by the processor, implements one or more steps in the gamma correction method as described in the embodiments of the first aspect.

In a fifth aspect, a computer program product is provided. When the computer program product runs on a computer, the computer is caused to execute one or more steps in the gamma correction method as described in the embodiments of the first aspect.

BRIEF DESCRIPTION OF THE DRAWINGS

In order to describe technical solutions in embodiments of the present disclosure more clearly, the accompanying drawings to be used in the description of embodiments will be introduced briefly. Obviously, the accompanying drawings to be described below are merely some embodiments of the present disclosure, and a person of ordinary skill in the art can obtain other drawings according to these drawings.

DETAILED DESCRIPTION

Some embodiments of the present disclosure will be described in combination with the accompanying drawings. Obviously, the described embodiments are merely some but not all of the embodiments of the present disclosure. All other embodiments made on the basis of the embodiments of the present disclosure by a person of ordinary skill in the art shall be included in the protection scope of the present disclosure.

Figure 1:
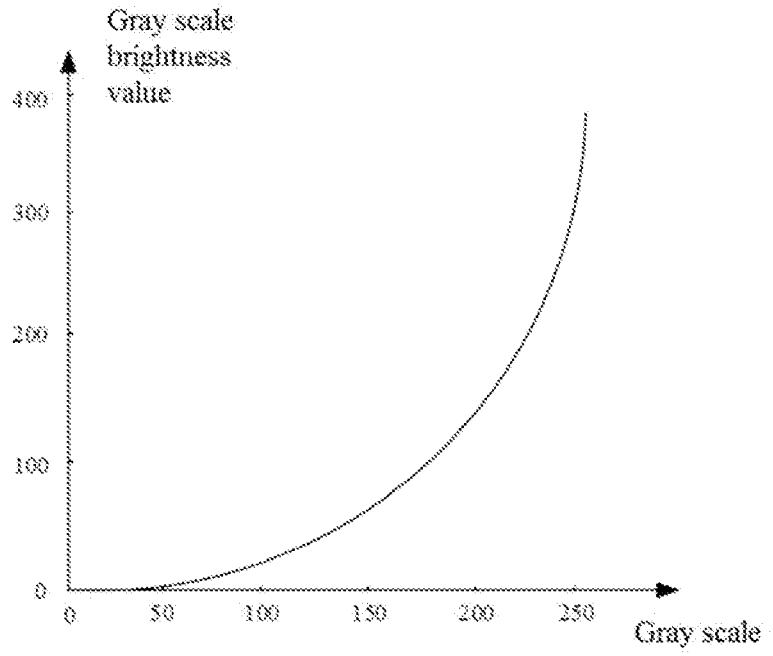
FIG. 1 is a schematic diagram of a gamma curve in the related art.

Since human eyes are much more sensitive to the brightness in a dark environment than in a bright environment, a relationship between human eye perception and brightness is not a linear relationship, but present a certain rule. As shown in FIG. 1, FIG. 1 shows a gamma curve, in which a horizontal axis represents pixel gray scale values (hereinafter referred to as gray scales) input to a pixel, and a vertical axis represents gray scale brightness values correspondingly output by the pixel. In order to make display effect of the organic light-emitting diode (OLED) display device meet visual perceptions of human eyes, a relationship between the input gray scale and the corresponding output gray scale brightness value needs to be set as that the gray scale brightness value is proportional to $\gamma$ power of the gray scale. The relationship between the gray scale brightness value and the gray scale is called a gamma curve of a display device. For example, the $\gamma$ value is set in a range from 2.2−0.2 to 2.2+0.2 (i.e., 2.2±0.2) to make displayed images close to what the human eyes actually see.

Before the OLED display device leaves the coefficient y, the OLED display device needs to be performed a gamma correction, so as to adjust a ratio of the gray scale brightness value to the γ power of the gray scale to a target value, for example, the target value is in a range from 2.2−0.2 to 2.2+0.2 (i.e., 2.2±0.2), so as to improve the display effect of the display device.

Generally, a display panel of the OLED display device has a brightness adjustment range, and the display brightness of the display device may be changed within the brightness adjustment range. In an ideal case, the gamma value of the gamma curve corresponding to each display brightness within the brightness adjustment range meets the target value, for example, the target value is in a range from 2.2−0.2 to 2.2+0.2 (i.e., 2.2±0.2). In this way, the display effect presented by the display device accords with the visual perception of human eyes at each display brightness.

In actual use of the display device, users adjust the display brightness of the display device (for example, a brightness slider of a display screen of an electronic terminal device such as a mobile phone is dragged to adjust the display brightness of the display screen of the electronic terminal device). Or, the display device automatically adjusts its display brightness in response to changes in the brightness of the surrounding environment. This is actually equivalent to switching the gamma curves corresponding to different display brightnesses.

To ensure that the gamma value of each gamma curve within the entire display brightness range of the display device meets the target value (for example, the target value is in a range from 2.2−0.2 to 2.2+0.2), there is a need to perform a gamma correction on each gamma curve corresponding to each display brightness in the entire brightness range, which undoubtedly results in a huge workload and takes too long time.

Figure 2:
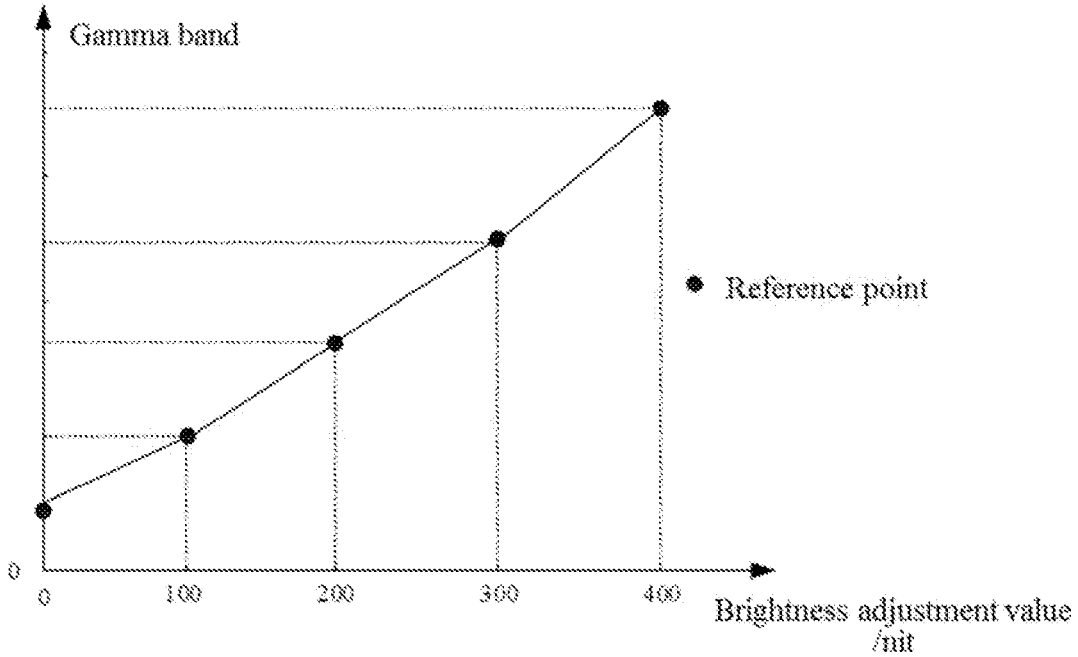
FIG. 2 is a schematic diagram of a brightness adjustment curve in the related art.
Figure 3:
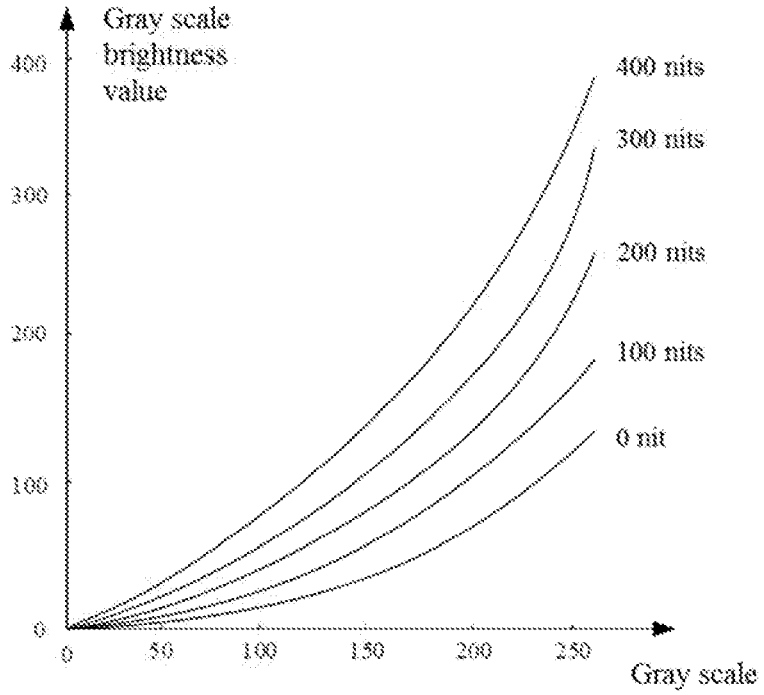
FIG. 3 is a schematic diagram of gamma curves at different brightness adjustment values in the related art.

In the related art, in order to save the workload of gamma correction, a brightness adjustment curve is obtained by arranging some reference points, for example, the number of reference points is four or five. As shown in FIG. 2, FIG. 2 shows a brightness adjustment curve. A horizontal axis represents brightness adjustment values, i.e., the display brightness of the display device. A vertical axis represents gamma bands corresponding to the brightness adjustment values; the gamma band refers to a set of register values (which can be understood as gray scale brightness values) corresponding to gray scales in the gamma curve corresponding to the brightness adjustment value. For example, the brightness adjustment curve includes five reference points, and the brightness adjustment values corresponding to the five reference points are 0 nit, 100 nits, 200 nits, 300 nits, and 400 nits, respectively. The brightness adjustment values respectively correspond to different gamma bands, and each gamma band corresponds to a gamma curve at a corresponding brightness adjustment value. Referring to FIG. 3, FIG. 3 shows gamma curves of the display device at 0 nit, 100 nits, 200 nits, 300 nits, and 400 nits. The five gamma curves are obtained through gamma correction, and the gamma values all meet the target value (for example, the target value is in a range from 2.2−0.2 to 2.2+0.2).

In the process of adjusting the display brightness of the display device according to the brightness adjustment curve shown in FIG. 2, in a case where the target brightness adjustment value (that is, a display brightness needs to be adjusted) is the brightness adjustment value corresponding to the reference point, the gamma curve of the display device is directly switched to a gamma curve determined by the gamma band corresponding to the brightness adjustment value. However, in a case where the target brightness adjustment value is not the brightness adjustment value corresponding to the reference point, for example, the target brightness adjustment value is between the brightness adjustment values corresponding to two adjacent reference points, in the related art, a gamma band corresponding to the target brightness adjustment value is obtained by performing a linear interpolation on the gamma bands corresponding to the two adjacent reference points, thereby determining a corresponding gamma curve.

However, with the above method, in a case where the target brightness adjustment value is a low brightness adjustment value, for example, the target brightness adjustment value is less than 10 nits, if the target brightness adjustment value is between the brightness adjustment values corresponding to two adjacent reference points, the displayed images may have a poor display phenomenon such as being reddish or greenish.

Current methods of adjusting a gray scale brightness value of a pixel include: a pulse width modulation (PWM) dimming mechanism and/or a driving signal dimming mechanism.

Figure 4A:
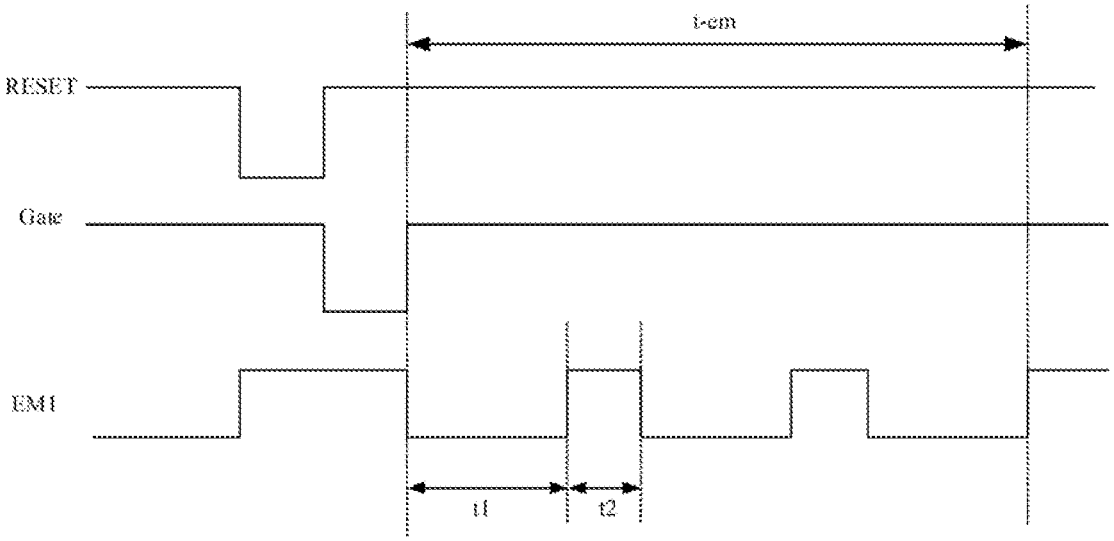
FIG. 4*a* is a schematic timing diagram of adjusting gray scale brightness values in the related art.

The PWM dimming mechanism is as shown in FIG. 4*a*. FIG. 4*a* shows a timing diagram of a frame of image signals. The RESET signal is a reset signal; the Gate signal is a scanning signal; in an example where a working level of the light-emitting signal EM1 is a low level, during a light-emitting phase t-em, the light-emitting signal EM1 includes a plurality of pulses. High level time (i.e., non-working level time) corresponding to each pulse corresponds to inactive regions t2, and remaining low level time corresponds to light-emitting regions t1. By adjusting a width of each pulse, a duty cycle of the light-emitting regions t1 is controlled (i.e., a ratio of the time of the light-emitting regions t1 to the total time of the light-emitting phase t-em), so as to achieve an adjustment of the actual light-emitting time in the entire light-emitting phase t-em, thereby achieving an adjustment of the gray scale brightness value of the pixel.

Figure 4B:
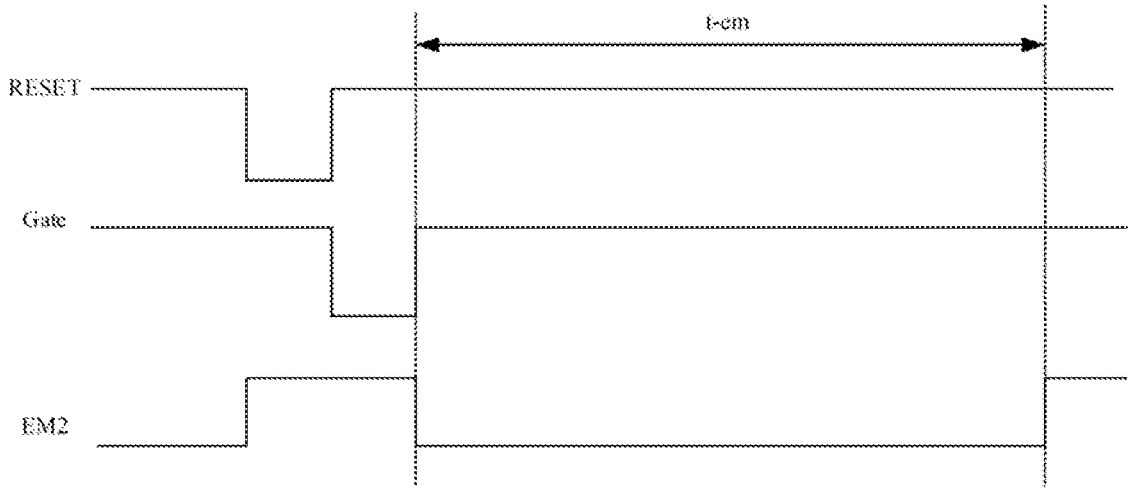
FIG. 4*b* is another schematic timing diagram of adjusting gray scale brightness values in the related art.

The driving signal dimming mechanism is as shown in FIG. 4*b*. FIG. 4*b* shows a timing diagram of a frame of image signals. The RESET signal is a reset signal; the Gate signal is a scanning signal; in an example where a working level of the light-emitting signal EM2 is a low level, during a light-emitting phase t-em, a potential of the light-emitting signal EM2 continues to be a low level (that is, a potential of the light-emitting signal EM2 continues to be a working level). That is, the pixel is in a light-emitting state during the entire light-emitting phase t-em. By adjusting a magnitude of the driving signal output from a driving integrated circuit (IC) of the display device to the pixel, that is, by controlling the magnitude of a driving current flowing through the light-emitting device corresponding to the pixel, the gray scale brightness value of the pixel is adjusted.

In a case where a target brightness adjustment value is between brightness adjustment values corresponding to two adjacent reference points, by using a method of performing a linear interpolation on the gamma bands corresponding to the two adjacent reference points in the related art, a gamma band corresponding to the target brightness adjustment value is obtained, thereby determining a corresponding gamma curve. Therefore, according to the determined gamma curve, the PWM dimming mechanism and/or the driving signal dimming mechanism are used to control the duty cycle of the light-emitting regions t1 and/or to adjust the magnitude of the driving signal, so as to achieve the adjustment of the gray scale brightness value of the pixel.

In a case where the target brightness adjustment value is between two adjacent reference brightness adjustment values, the above method does not adapt to changes in the characteristics of light-emitting materials of the OLED display device, which is embodied as follows.

Figure 5:
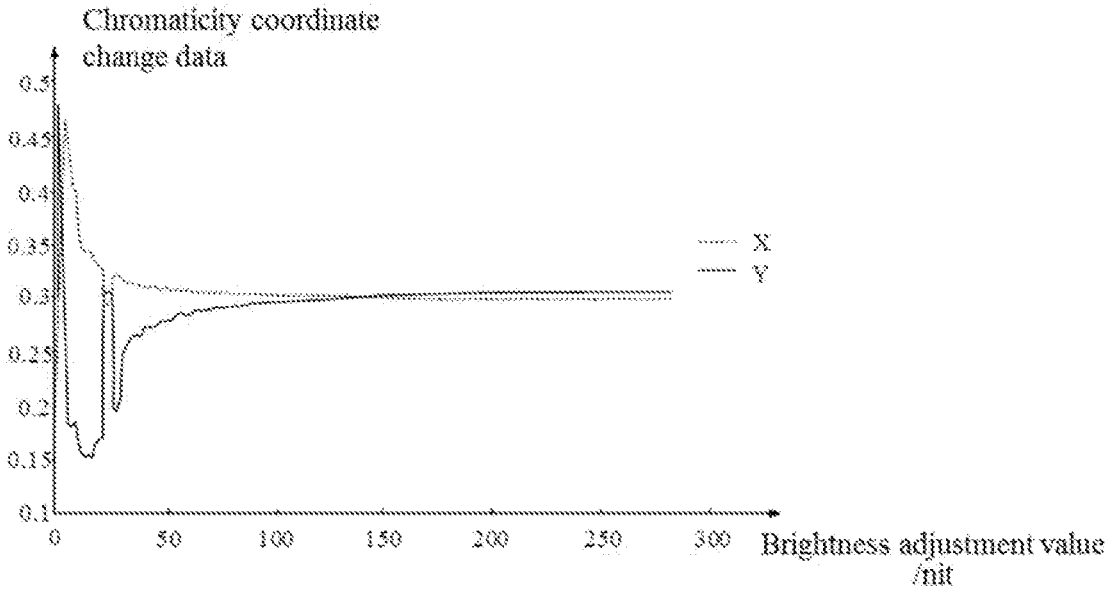
FIG. 5 is a schematic diagram of a chromaticity coordinate change curve in a brightness adjustment value range from 0 nit to 300 nits in the related art.

In a case where the PWM dimming mechanism is used for brightness adjustment, as shown in FIG. 5, FIG. 5 shows a chromaticity coordinate change curve in a brightness adjustment value range from 0 nit to 300 nits, where X represents a horizontal axis in the chromaticity coordinate, and Y represents a vertical axis in the chromaticity coordinate. (It should be noted that the chromaticity coordinate is a coordinate of colors, also referred to as a color system. It is a commonly used color coordinate now. The horizontal axis is X, the vertical axis is Y, and (X, Y) is used to represent one color. National television standards committee (NTSC) stipulates that a standard red chromaticity coordinate is (0.67, 0.33), a standard green chromaticity coordinate is (0.21, 0.71), a standard blue chromaticity coordinate is (0.14, 0.08), and a pure white chromaticity coordinate is (0.33, 0.33). In the chromaticity coordinate, in a case where a value of the horizontal axis X and a value of the vertical axis Y are both around 0.3, in the chromaticity coordinate, a displayed color is white. In a case where the value of the horizontal axis X is greater than 0.3 and greater than the value of the vertical axis Y (it can also be said that X is greater than Y), in the chromaticity coordinate, the displayed color is reddish. In a case where the value of the vertical axis Y is greater than 0.3 and greater than the value of the horizontal axis X (it can also be said that X is less than Y), in the chromaticity coordinate, the displayed color is greenish). It may be seen that according to the PWM dimming mechanism, within a low brightness adjustment value range, the value of the horizontal axis X is greater than the value of the vertical axis Y. In the chromaticity coordinate, the displayed color is reddish. That is, an attenuation speed of green pixels is greater than an attenuation speed of red pixels. Therefore, the displayed image appears red.

Figure 6:
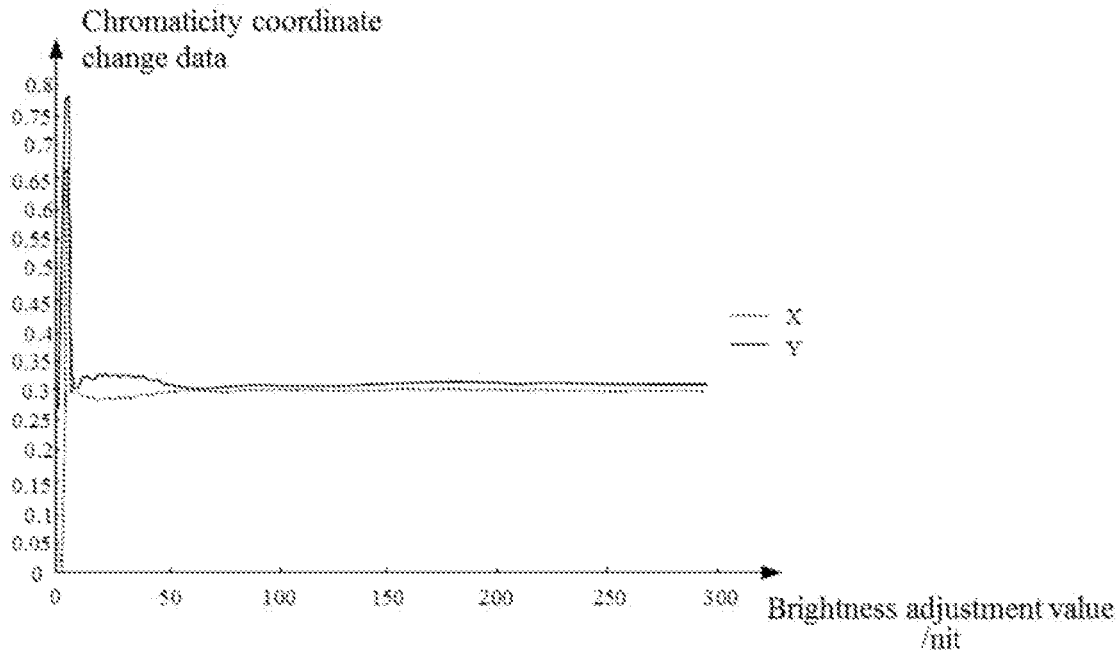
FIG. 6 is another schematic diagram of a chromaticity coordinate change curve in a brightness adjustment value range from 0 nit to 300 nits in the related art.

In a case where the brightness is adjusted by combining the driving signal dimming mechanism and the PWM dimming mechanism, as shown in FIG. 6, FIG. 6 shows a chromaticity coordinate change curve in a brightness adjustment value range from 0 nit to 300 nits, where X represents a horizontal axis in the chromaticity coordinate, Y represents a vertical axis in the chromaticity coordinate. It may be seen that, by adopting the combination of the driving signal dimming mechanism and PWM dimming mechanism, within the low brightness adjustment value range, the value of the horizontal axis X is smaller than the value of the vertical axis Y, and in the chromaticity coordinate, the displayed color is greenish. That is, the attenuation speed of the green pixels is less than the attenuation speed of the red pixels. Therefore, the displayed image appears green.

It may be seen that a gamma correction algorithm in the related art is used to obtain the gamma bands corresponding to the brightness adjustment values other than the reference brightness adjustment values by performing the linear interpolation between the reference brightness adjustment values. Since the method does not adapt to the characteristics of the light-emitting materials of the OLED display device, at low brightness adjustment values, the displayed images may have a poor display phenomenon such as being reddish or greenish at brightness adjustment values which are between the reference brightness adjustment values.

Figure 7:
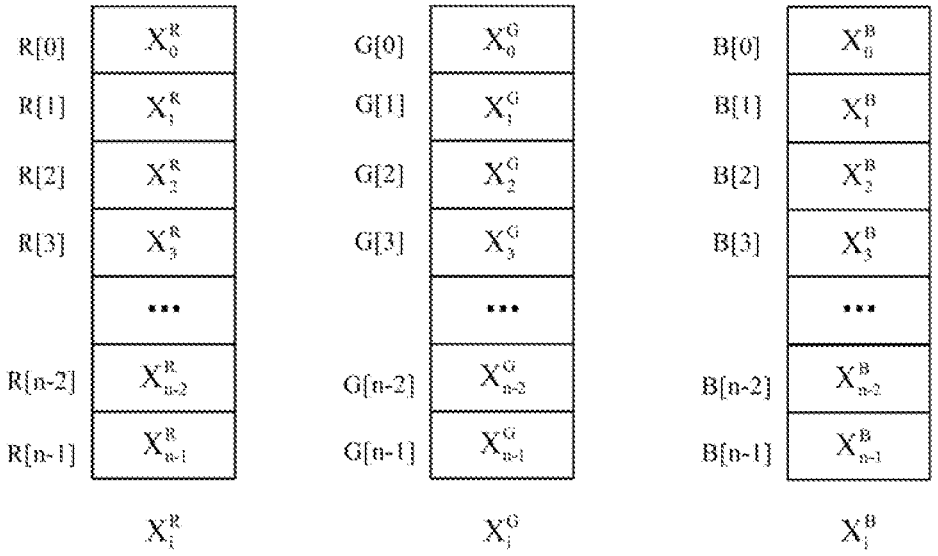
FIG. 7 is a schematic diagram of a gamma register used in a gamma correction method, in accordance with some embodiments of the present disclosure.

In the display device, with respect to a gamma curve at a certain brightness adjustment value, gray scale brightness values corresponding to gray scales are stored through a register. As shown in FIG. 7, a structure of the gamma register is that: R[x] represents a red register address, G[x] represents a green register address, and B[x] represents a blue register address. Herein, x is equal to 0 to n−1, and n is a maximum number of gray scales that the display device may display. For example, n is 256. Hereinafter, the gray scale brightness values stored in the register addresses are collectively referred to as register value $X_i$, and i is equal to 0 to n−1. For example, a red register value is expressed as $X_i^R$, and a green register value is expressed as $X_i^G$, and a blue register value is expressed as $X_i^B$.

Figure 8:
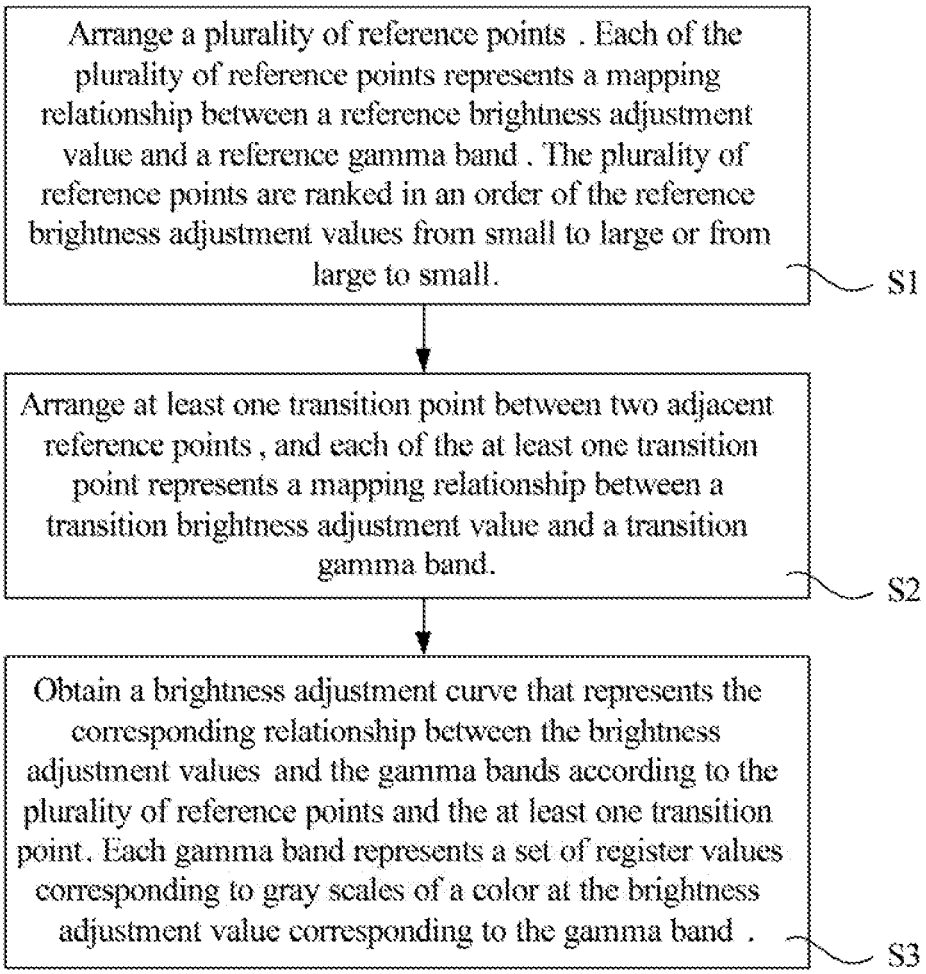
FIG. 8 is a flow diagram of a gamma correction method, in accordance with some embodiments of the present disclosure.

Some embodiments of the present disclosure provide a gamma correction method. The gamma correction method is applied to a display screen to be debugged. As shown in FIG. 8, the gamma correction method includes, with respect to a color of the display screen to be debugged (in the following description, the color is red; it will be noted that the color herein may also be another color, such as blue or green, which depends on the color that may be displayed on the display screen to be debugged; red herein is only an example), the following steps.

S1: a plurality of reference points are arranged. Each of the plurality of reference points represents a mapping relationship between the reference brightness adjustment value and the reference gamma band. The plurality of reference points are ranked in an order of the reference brightness adjustment values from small to large or from large to small.

Figure 9:
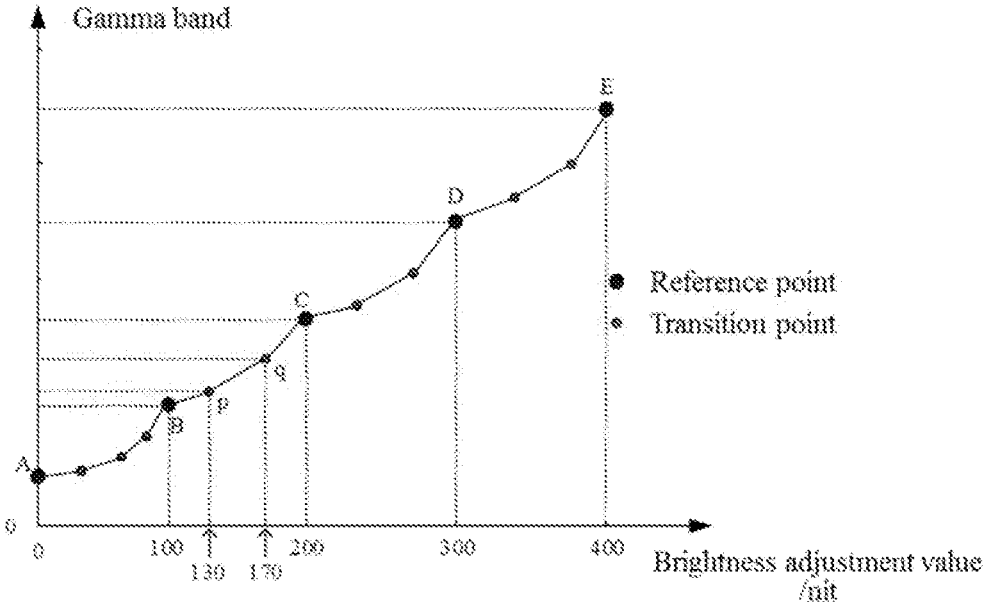
FIG. 9 is a schematic diagram of a brightness adjustment curve obtained by a gamma correction method, in accordance with some embodiments of the present disclosure.

In the above step, as shown in FIG. 9, in the diagram of a corresponding relationship between the brightness adjustment values and the gamma bands, the horizontal axis represents the brightness adjustment values, the vertical axis represents the gamma bands, and solid dots represent a plurality of arranged reference points. Each reference point represents a corresponding relationship between the reference brightness adjustment value and the reference gamma band. For example, red is taken as an example, and the reference brightness adjustment values are multiple brightness adjustment values at specific positions within the brightness adjustment value range corresponding to the red sub-pixel. Each reference gamma band represents a set of red register values $[X_0^R(C), X_1^R(C), X_2^R(C) \ldots X_{n-1}^R(C)]$ corresponding to gray scales at the reference brightness adjustment value corresponding to the reference gamma band.

Figure 10:
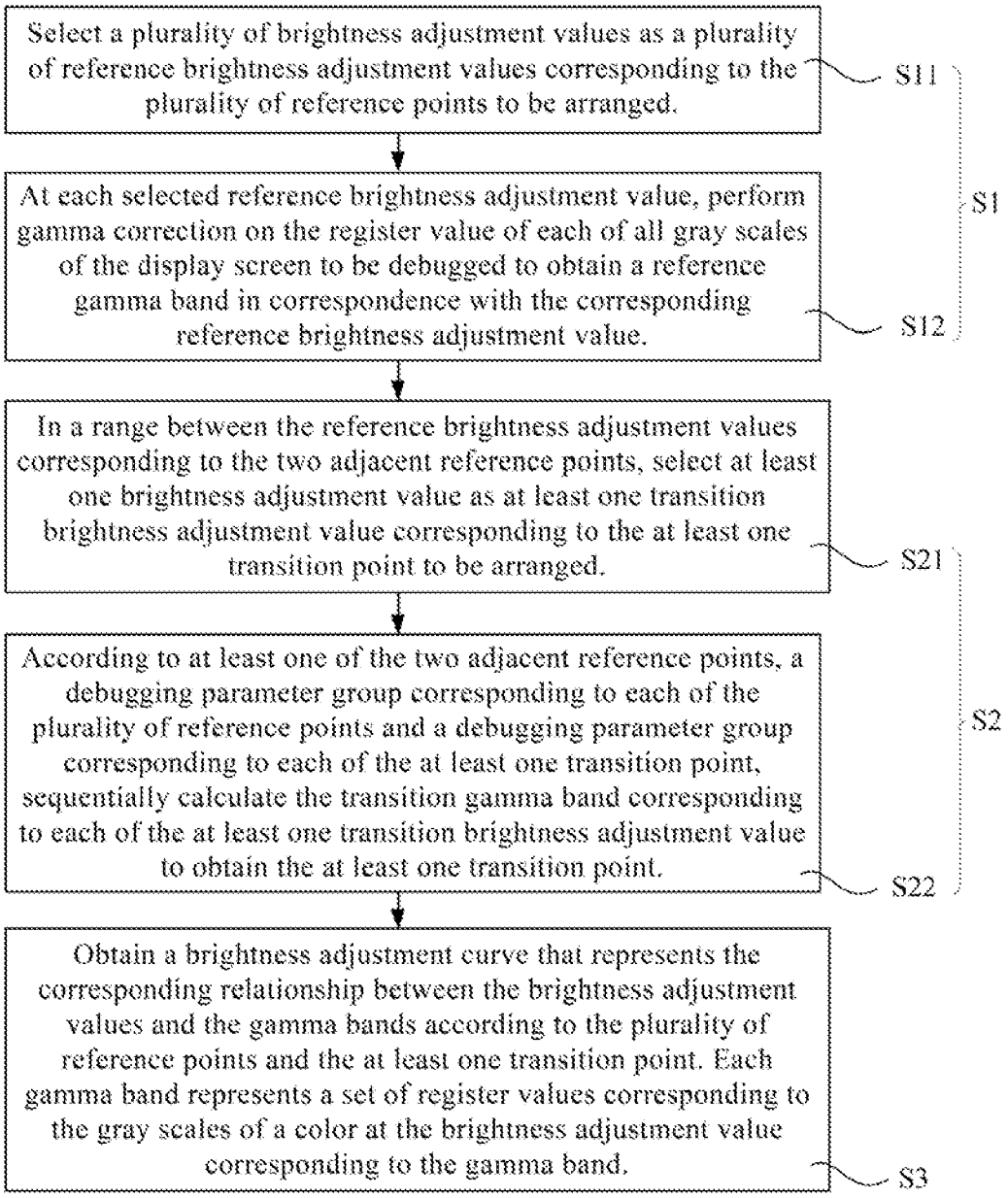
FIG. 10 is another flow diagram of a gamma correction method, in accordance with some embodiments of the present disclosure.

In some embodiments, as shown in FIG. 10, arranging the plurality of reference points in S1 includes the following processes.

S11: a plurality of brightness adjustment values are selected as a plurality of reference brightness adjustment values corresponding to the plurality of reference points to be arranged.

S12: at each selected reference brightness adjustment value, gamma correction is performed on the register values of the gray scales of the display screen to be debugged to obtain a reference gamma band in correspondence with the corresponding reference brightness adjustment value.

At each reference brightness adjustment value, gamma correction is performed on the register values of the gray scales of the display screen to be debugged to obtain the reference gamma band in correspondence with the corresponding reference brightness adjustment value, which is to make the gamma value of the gamma curve at each reference brightness adjustment value meet the target value (for example, the target value is in a range from 2.2−0.2 to 2.2+0.2). In a case where the brightness adjustment value of the display device is at the reference brightness adjustment value, the image displayed by the display device meets visual perceptions of human eyes.

In some embodiments, the number of the reference points is four to five. For example, as shown in FIG. 9, the number of the reference points is five. In a case where the entire brightness adjustment value range is from 0 nit to 400 nits, the brightness adjustment values corresponding to the five reference points are a first reference brightness adjustment value (0 nit), a second reference brightness adjustment value (100 nits), a third reference brightness adjustment value (200 nits), a fourth reference brightness adjustment value (300 nits), and a fifth reference brightness adjustment value (400 nits).

For example, with continuous reference to FIG. 9, the plurality of reference points are ranked in an order of brightness adjustment values from small to large, and the five reference points are a reference point A, a reference point B, a reference point C, a reference point D, and a reference point E from left to right. For example, the reference gamma band corresponding to the reference point A represents a set of red register values $[X_0^R(C_A), X_1^R(C_A), X_2^R(C_A) \ldots X_{n-1}^R(C_A)]$ corresponding to gray scales at 0 nit. The reference gamma band corresponding to the reference point B represents a set of the red register values $[X_0^R(C_B), X_1^R(C_B), X_2^R(C_B) \ldots X_{n-1}^R(C_B)]$ corresponding to gray scales at 100 nits. Other reference points may be referred to the above description.

S2: at least one transition point is arranged between two adjacent reference points, and each of the at least one transition point represents a mapping relationship between a transition brightness adjustment value and a transition gamma band.

In the above steps, with reference to FIG. 9, for example, three transition points are arranged between the reference point A and the reference point B. Two transition points are disposed between the reference point B and the reference point C, between the reference point C and the reference point D, between the reference point D and the reference point E, and each transition point represents a corresponding relationship between the transition brightness adjustment value and the transition gamma band. For example, red is taken as an example, and the transition brightness adjustment value is a brightness adjustment value selected between the reference brightness adjustment values of the red sub-pixel corresponding to two adjacent reference points. Each transition gamma band represents a set of red register values $[X_0^R(G), X_1^R(G), X_2^R(G) \ldots X_{n-1}^R(G)]$ corresponding to the gray scales at the transition brightness adjustment value corresponding to the transition gamma band.

For example, with respect to a transition point p and a transition point q disposed between the reference point B and the reference point C, the transition gamma band corresponding to the transition point p represents a set of red register values $[X_0^R(G_p), X_1^R(G_p), X_2^R(G_p) \ldots X_{n-1}^R(G_p)]$ corresponding to the gray scales at 130 nits. The reference gamma band corresponding to the transition point q represents a set of red register values $[X_0^R(G_q), X_1^R(G_q), X_2^R(G_q) \ldots X_{n-1}^R(G_q)]$ corresponding to the gray scales at 170 nits.

The transition point has the same function as the reference point, and both are feature points that represent the mapping relationship between the brightness adjustment value and the gamma band. At each transition brightness adjustment value, a set of register values corresponding to the gray scales is a corresponding gamma band, and the gamma value of the gamma curve at each transition brightness adjustment value is close to or in line with the target value (the target value is in a range from 2.2−0.2 to 2.2+0.2). In a case where the brightness adjustment value of the display device is at the transition brightness adjustment value, the displayed image meets the visual perceptions of human eyes.

S3: a brightness adjustment curve that represents the corresponding relationship between the brightness adjustment values and the gamma bands is obtained according to the plurality of reference points and the at least one transition point. Herein, each gamma band represents a set of register values corresponding to the gray scales of a color (red is taken as an example) at the brightness adjustment value corresponding to the gamma band.

In the above steps, for example, as shown in FIG. 9, according to five reference points (the reference point A, the reference point B, the reference point C, the reference point D, and the reference point E) and nine transition points, the brightness adjustment curve that represents the corresponding relationship between the brightness adjustment values and the gamma bands is obtained. In FIG. 9, according to the brightness adjustment curve, the gamma band corresponding to each brightness adjustment value in the entire brightness adjustment value range may be obtained. In the process of adjusting the display brightness of the display device according to the brightness adjustment curve shown in FIG. 9, the gamma curve of the display device is directly switched to the gamma curve determined by the gamma band in correspondence with the corresponding brightness adjustment value.

The gamma correction method provided by the present disclosure obtains the mapping relationship between the reference brightness adjustment values and the reference gamma bands by means of arranging the plurality of reference points, and obtains the mapping relationship between the transition brightness adjustment value(s) and the transition gamma band(s) by means of arranging at least one transition point. According to the gamma correction method, the plurality of reference points are provided first, and then the at least one transition point between two adjacent reference points are provided. The at least one transition point is obtained according to the reference points, and does not need to be obtained through the gamma correction at the transition brightness adjustment value. Therefore, the time for correction will not increase.

In some embodiments, in the process of adjusting the brightness of the display device according to the brightness adjustment curve obtained by the above method, in a case where the target brightness adjustment value is the brightness adjustment value corresponding to the reference point or the transition point, the current gamma curve is directly switched to a gamma curve determined by the gamma band corresponding to the target brightness adjustment value. In a case where the target brightness adjustment value is not the brightness adjustment value corresponding to the reference point or the transition point, for example, the target brightness adjustment value is between the brightness adjustment values corresponding to two adjacent points (i.e., two adjacent reference points, or two adjacent transition points, or one reference point and one transition point that are adjacent), the gamma bands corresponding to two adjacent points may be performed the linear interpolation to obtain the gamma band corresponding to the target brightness adjustment value, and the current gamma curve may be switched to the gamma curve determined by the gamma band obtained through the linear interpolation.

In this way, compared with the method of obtaining the gamma band corresponding to the target brightness adjustment value by directly using linear interpolation between two adjacent reference points in the prior art, the gamma correction method provided in the present disclosure does not increase a workload of performing gamma correction (for example, the gamma correction is performed at five reference brightness adjustment values to obtain five reference points; at least one transition point is arranged between two adjacent reference points, and the transition point is not obtained by performing the gamma correction, but is obtained according to the reference points), so that the number of points that represent the corresponding relationship between the brightness adjustment values and the gamma bands increases. According to these points, the obtained brightness adjustment curve that represents the corresponding relationship between the brightness adjustment values and the gamma bands is more accurate and in line with the characteristics of the light-emitting materials of the OLED display device, thereby improving the poor display phenomena of the display device, which occur at the low brightness adjustment values, such as being reddish and greenish that appear in the image displayed at the brightness adjustment value between the reference brightness adjustment values, and improving the display effect of the display device.

It will be noted that the gamma correction method provided by the embodiments of the present disclosure is not only suitable for OLED display devices, but also suitable for other active light-emitting display devices that have display quality problems due to the aforementioned reasons, such as quantum dot light-emitting diode (QLED) display devices, micro light-emitting diode (Micro LED) display devices, which is not limited in the present disclosure.

In some embodiments, as shown in FIG. 10, in S2, the step that at least one transition point is disposed between two adjacent reference points includes the following steps.

S21: in a range between the reference brightness adjustment values corresponding to two adjacent reference points, at least one brightness adjustment value is selected as at least one transition brightness adjustment value corresponding to the at least one transition point to be arranged.

For example, as shown in FIG. 9, two brightness adjustment values (such as 130 nits and 170 nits) between two reference brightness adjustment values (the second reference brightness adjustment value (100 nits) and the third reference brightness adjustment value (200 nits) corresponding to the reference point B and the reference point C) are selected, and are used as two transition brightness adjustment values corresponding to two transition points to be arranged. According to the order of the transition brightness adjustment values from small to large, the two transition points to be arranged are referred to as a transition point p and a transition point q, and the corresponding transition brightness adjustment values thereof are a first transition brightness adjustment value (130 nits) and a second transition brightness adjustment value (170 nits).

S22: according to at least one of the two adjacent reference points, a debugging parameter group corresponding to each of the plurality of reference points, and a debugging parameter group corresponding to each of the at least one transition point, the transition gamma band corresponding to each of the at least one transition brightness adjustment value is sequentially calculated to obtain the at least one transition point.

For example, according to the reference point B and the debugging parameter group corresponding to the reference point B, the transition gamma band corresponding to the first transition brightness adjustment value (130 nits) is calculated to obtain the transition point p. And then, according to the transition point p and the debugging parameter group corresponding to the transition point p, the transition gamma band corresponding to the second transition brightness adjustment value (170 nits) is calculated to obtain the transition point q.

Herein, each debugging parameter group represents a set of debugging parameters of register values corresponding to the gray scales of the color at the brightness adjustment value corresponding to the point which is corresponding to the debugging parameter group.

For example, red is taken as an example; the debugging parameter group of reference point B represents, at 100 nits, a set of debugging parameters of the register values corresponding to the gray scales of red, i.e., a set of debugging parameters of the red register value $X^R(C_B)$ corresponding to the gray scales at 100 nits.

In the above embodiments, the manner of arranging at least one transition point between two adjacent reference points is that, according to at least one of the two adjacent reference points, a debugging parameter group corresponding to each of the plurality of reference points, and a debugging parameter group corresponding to each of the at least one transition point, the transition gamma band corresponding to each of the at least one transition brightness adjustment value is sequentially calculated. That is, the at least one transition point is obtained according to the reference points, the debugging parameter group corresponding to each reference point, and the debugging parameter group corresponding to each transition point. There is no need to perform gamma correction on the gamma curve at the transition brightness adjustment value. Therefore, it will not increase the gamma correction time, and the brightness adjustment curve obtained according to the plurality of reference points and the at least one transition points is more accurate.

In some embodiments, S22 includes the following processes.

According to the order of the transition brightness adjustment values from small to large, the transition gamma band corresponding to each of the at least one transition brightness adjustment value is sequentially calculated.

For example, referring to FIG. 9, with respect to the transition points between the reference point B and the reference point C, according to the order of the transition brightness adjustment values from small to large, the transition gamma band corresponding to the first transition brightness adjustment value (130 nits) is calculated first, and then the transition gamma band corresponding to the second transition brightness adjustment value (170 nits) is calculated.

Figure 11:
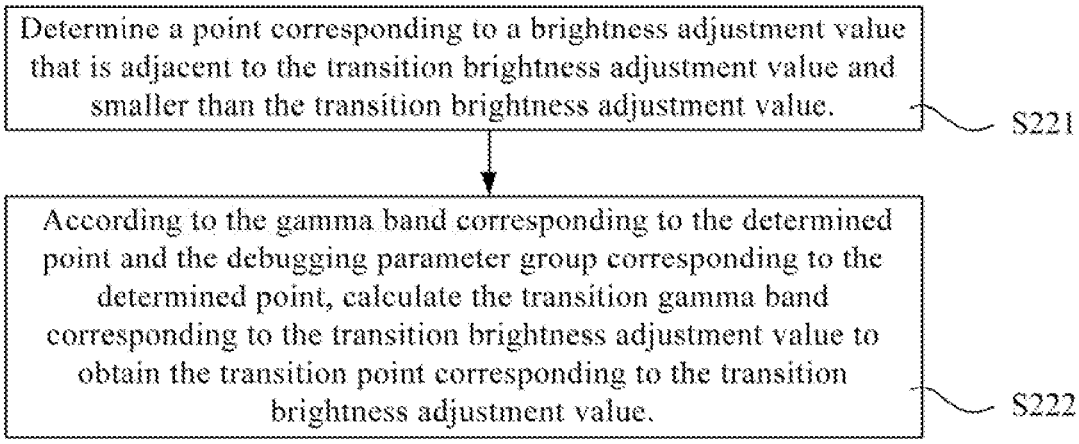
FIG. 11 is yet another flow diagram of a gamma correction method, in accordance with some embodiments of the present disclosure.

As shown in FIG. 11, with respect to each transition brightness adjustment value:

S221: a point corresponding to a brightness adjustment value, which is adjacent to the transition brightness adjustment value and smaller than the transition brightness adjustment value, is determined.

For example, as shown in FIG. 9, with respect to the first transition brightness adjustment value (130 nits), the brightness adjustment value adjacent to the transition brightness adjustment value and smaller than the transition brightness adjustment value is the second reference brightness adjustment value (100 nits), and the point corresponding to the second reference brightness adjustment value (100 nits) is the reference point B.

With respect to the second transition brightness adjustment value (170 nits), the brightness adjustment value adjacent to the transition brightness adjustment value and smaller than the transition brightness adjustment value is the first transition brightness adjustment value (130 nits), and the point corresponding to the first transition brightness adjustment value (130 nits) is the transition point p to be arranged.

S222: the transition gamma band corresponding to the transition brightness adjustment value is calculated according to the gamma band corresponding to the determined point and the debugging parameter group corresponding to the determined point, so as to obtain the transition point corresponding to the transition brightness adjustment value.

For example, with respect to the first transition brightness adjustment value (130 nits), the transition gamma band corresponding to the first transition brightness adjustment value (130 nits) is calculated according to the reference gamma band corresponding to the reference point B and the debugging parameter group corresponding to the reference point B, so as to obtain the transition point p corresponding to the first transition brightness adjustment value (130 nits).

After the transition point p is obtained, with respect to the second transition brightness adjustment value (170 nits), the transition gamma band corresponding to the second transition brightness adjustment value (170 nits) is calculated according to the transition gamma band corresponding to the transition point p and the debugging parameter group corresponding to the transition point p, so as to obtain the transition point q corresponding to the second transition brightness adjustment value (170 nits).

In some other embodiments, S22 includes the following processes.

According to the order of the transition brightness adjustment values from large to small, the transition gamma band corresponding to each of the at least one transition brightness adjustment value is sequentially calculated.

For example, referring to FIG. 9, with respect to the transition points between the reference point B and the reference point C, according to the order of the brightness adjustment value from large to small, the transition gamma band corresponding to the second transition brightness adjustment value (170 nits) is calculated first, and then the transition gamma band corresponding to the first transition brightness adjustment value (130 nits) is calculated.

Figure 12:
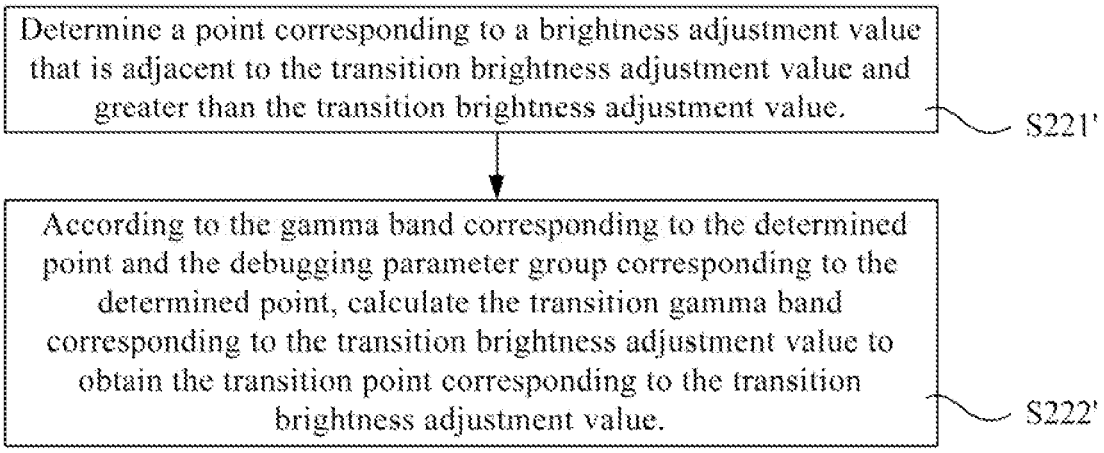
FIG. 12 is yet another flow diagram of a gamma correction method, in accordance with some embodiments of the present disclosure.

As shown in FIG. 12, with respect to each transition brightness adjustment value:

S221': a point corresponding to a brightness adjustment value, which is adjacent to the transition brightness adjustment value and greater than the transition brightness adjustment value, is determined.

For example, as shown in FIG. 9, with respect to the second transition brightness adjustment value (170 nits), the brightness adjustment value adjacent to the transition brightness adjustment value and greater than the transition brightness adjustment value is the third reference brightness adjustment value (200 nits), and the point corresponding to the third reference brightness adjustment value (200 nits) is the reference point C.

With respect to the first transition brightness adjustment value (130 nits), the brightness adjustment value adjacent to the transition brightness adjustment value and grater than the transition brightness adjustment value is the second transition brightness adjustment value (170 nits), and the point corresponding to the second transition brightness adjustment value (170 nits) is the transition point q to be arranged.

S222': the transition gamma band corresponding to the transition brightness adjustment value is calculated according to the gamma band corresponding to the determined point and the debugging parameter group corresponding to the determined point, so as to obtain the transition point corresponding to the transition brightness adjustment value.

For example, with respect to the second transition brightness adjustment value (170 nits), the transition gamma band corresponding to the second transition brightness adjustment value (170 nits) is calculated according to the reference gamma band corresponding to the reference point C and the debugging parameter group corresponding to the reference point C, so as to obtain the transition point q corresponding to the second transition brightness adjustment value (170 nits).

After the transition point q is obtained, with respect to the first transition brightness adjustment value (130 nits), the transition gamma band corresponding to the first transition brightness adjustment value (130 nits) is calculated according to the transition gamma band corresponding to the transition point q and the debugging parameter group corresponding to the transition point q, so as to obtain the transition point p corresponding to the first transition brightness adjustment value (130 nits).

In some embodiments, the debugging parameter group corresponding to the determined point includes debugging parameters of register values corresponding to the gray scales of the color; the debugging parameter includes a coefficient a and a gain b of the register value corresponding to the debugging parameter.

Figure 13:
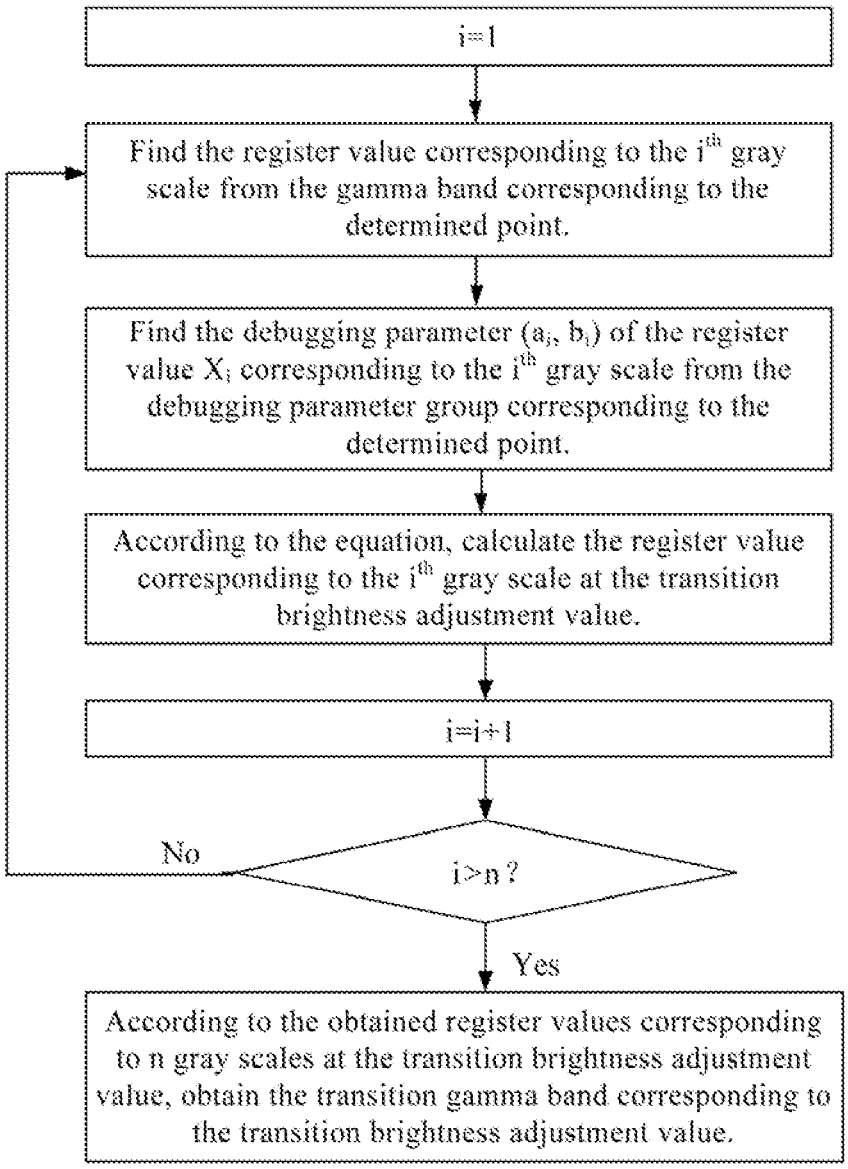
FIG. 13 is yet another flow diagram of a gamma correction method, in accordance with some embodiments of the present disclosure.

As shown in FIG. 13, in S222 or S222', the step where the transition gamma band corresponding to the transition brightness adjustment value is calculated according to the gamma band corresponding to the determined point and the debugging parameter group corresponding to the determined point, includes the following processes.

A register value $X_i$ corresponding to the $i^{th}$ gray scale is found out from the gamma band corresponding to the determined point.

A debugging parameter ($a_i$, $b_i$) of the register value $X_i$ corresponding to the $i^{th}$ gray scale is found out from the found debugging parameter group.

According to an equation $X'_i=a_i \times X_i+b_i$, the register value $X'_i$ corresponding to the $i^{th}$ gray scale at the transition brightness adjustment value is calculated.

Denote i is equal to 1 to n, and the above steps are repeatedly implemented. According to the calculated register values $X'_1$ to $X'_n$ corresponding to the n gray scales at the transition brightness adjustment value, the transition gamma band corresponding to the transition brightness adjustment value is obtained. Herein, n represents the number of gray scales of one color of the display screen to be debugged.

Figure 14A:
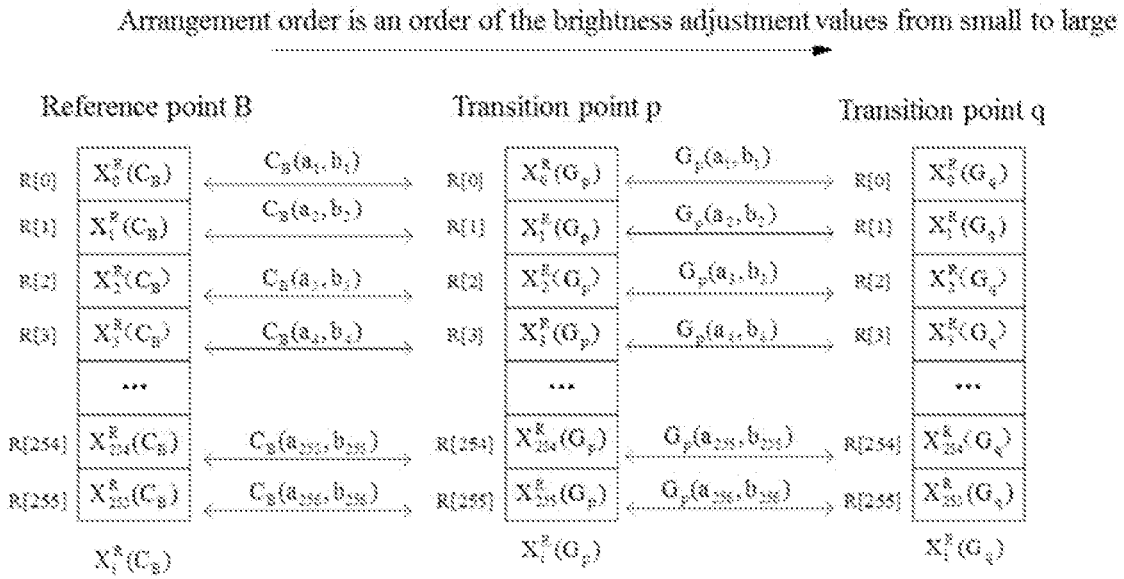
FIG. 14*a* is a schematic diagram of a corresponding relationship of register values of a gamma correction method, in accordance with some embodiments of the present disclosure.

With reference to FIG. 14*a*, red is taken as an example; in a case where the number of the gray scales of the display screen to be debugged is 256, the specific steps of S222 will be exemplarily described.

In a case where the transition gamma band corresponding to each of the at least one transition brightness adjustment value is sequentially calculated according to the order of the transition brightness adjustment values from small to large:

In S222, with respect to the first transition brightness adjustment value (130 nits), the determined point is the reference point B.

At the second reference brightness adjustment value (100 nits) corresponding to the reference point B, in the corresponding gamma curve, the red register values corresponding to the gray scales of 0 to 255 are $X_0^R(C_B)$, $X_1^R(C_B)$, $X_2^R(C_B)$ . . . $X_{255}^R(C_B)$.

The first transition brightness adjustment value (130 nits) corresponds to the transition point p to be arranged. At the first transition brightness adjustment value (130 nits), the red register values $X_0^R(G_p)$, $X_1^R(G_p)$, $X_2^R(G_p)$ . . . $X_{255}^R(G_p)$ corresponding to the gray scales from 0 to 255 need to be calculated.

With respect to the reference point B and the transition point p to be arranged, at a same gray scale, there is a corresponding relationship between the red register values. For example, there is a corresponding relationship between the red register value $X_0^R(C_B)$ and the red register value $X_0^R(G_p)$ both corresponding to 0 gray scale, and the corresponding relationship is referred to as the debugging parameter $C_B(a_1, b_1)$ of the red register values corresponding to the 0 gray scale at the reference point B. The debugging parameter includes a coefficient $a_1$ and a gain $b_1$ of the red register values corresponding to the 0 gray scale. There is a corresponding relationship between the red register value $X_1^R(C_B)$ and the red register value $X_1^R(G_p)$ corresponding to 1 gray scale, and the corresponding relationship is referred to as the debugging parameter $C_B(a_2, b_2)$ of the red register values corresponding to 1 gray scale at the reference point B. The debugging parameter includes a coefficient $a_2$ and a gain $b_2$ of the red register values corresponding to the 1 gray scale. Similarly, the set of debugging parameters of the red register values corresponding to the gray scales is the debugging parameter group $C_B(a_i, b_i)$ corresponding to the reference point B, and i is equal to 1 to n.

According to the gamma band corresponding to the reference point B and the debugging parameter group corresponding to the reference point B, the transition gamma band corresponding to the first transition brightness adjustment value (130 nits) is calculated, and the specific steps are as follows.

Denote i is equal to 1, and the red register value $X_0^R(C_B)$ corresponding to the first gray scale (0 gray scale) is found out from the gamma band corresponding to the reference point B.

The debugging parameter $C_B(a_1, b_1)$ of the red register value $X_0^R(C_B)$ corresponding to the first gray scale (0 gray scale) is found out from the found debugging parameter group.

According to the equation $X'_i=a_i \times X_i+b_i$, the red register value $X_0^R(G_p)$ corresponding to the first gray scale (0 gray scale) at the first transition brightness adjustment value is calculated.

Denote i is equal to 2, the red register value $X_1^R(C_B)$ corresponding to the second gray scale (1 gray scale) is found out from the gamma band corresponding to the reference point B.

The debugging parameter $C_B(a_2, b_2)$ of the red register value $X_1^R(C_B)$ corresponding to the second gray scale (1 gray scale) is found out from the found debugging parameter group.

According to the equation $X'_i=a_i \times X_i+b_i$, the red register value $X_1^R(G_p)$ corresponding to the second gray scale (1 gray scale) at the first transition brightness adjustment value is calculated.

Denote i is equal to i+1, and the above steps are repeated until i is greater than 256. The red register values ($X_0^R(G_p)$, $X_1^R(G_p)$, $X_2^R(G_p)$ . . . $X_{255}^R(G_p)$) corresponding to the 256 gray scales at the first transition brightness adjustment value (130 nits) are sequentially calculated, so as to obtain the transition gamma band corresponding to the first transition brightness adjustment value (130 nits).

After the transition gamma band corresponding to the first transition brightness adjustment value (130 nits) is obtained, the transition gamma band corresponding to the second transition brightness adjustment value (170 nits) is then calculated.

In S222, with respect to the second transition brightness adjustment value (170 nits), the determined point is the transition point p.

At the first transition brightness adjustment value (130 nits) corresponding to the transition point p, in the corresponding gamma curve, the red register values corresponding to the gray scales of 0 to 255 are $X_0^R(G_p)$, $X_1^R(G_p)$, $X_2^R(G_p)$ . . . $X_{255}^R(G_p)$.

The second transition brightness adjustment value (170 nits) corresponds to the transition point q to be arranged. At the second transition brightness adjustment value (170 nits), the red register values $X_0^R(G_q)$, $X_1^R(G_q)$, $X_2^R(G_q)$ . . . $X_{255}^R(G_q)$ corresponding to the gray scales from 0 to 255 need to be calculated.

With respect to the transition point p and the transition point q to be arranged, at a same gray scale, there is a corresponding relationship between the red register values. A set of debugging parameters of the red register values corresponding to the gray scales is the debugging parameter group $G_p(a_i, b_i)$ corresponding to the transition point p, and i is equal to 1 to n.

According to the gamma band corresponding to the transition point p and the debugging parameter group $G_p(a_i, b_i)$ corresponding to the transition point p, the transition gamma band corresponding to the second transition brightness adjustment value (170 nits) is calculated, and the specific steps are as follows.

Denote i is equal to 1, and the red register value $X_0^R(G_p)$ corresponding to the first gray scale (0 gray scale) is found out from the gamma band corresponding to the transition point p.

The debugging parameter $G_p(a_1, b_1)$ of the red register value $X_0^R(G_p)$ corresponding to the first gray scale (0 gray scale) is found out from the found debugging parameter group.

According to the equation $X'_i=a_i \times X_i+b_i$, the red register value $X_0^R(G_q)$ corresponding to the first gray scale (0 gray scale) at the second transition brightness adjustment value (170 nits) is calculated.

Denote i is equal to 2, the red register value $X_1^R(G_p)$ corresponding to the second gray scale (1 gray scale) is found out from the gamma band corresponding to the transition point p.

The debugging parameter $G_p(a_2, b_2)$ of the red register value $X_1^R(G_p)$ corresponding to the second gray scale (1 gray scale) is found out from the found debugging parameter group.

According to the equation $X'_i=a_i \times X_i+b_i$, the red register value $X_1^R(G_q)$ corresponding to the second gray scale (1 gray scale) at the second transition brightness adjustment value (170 nits) is calculated.

Denote i is equal to i+1, and the above steps are repeated until i is greater than 256. The red register values ($X_0^R(G_q)$, $X_1^R(G_q)$, $X_2^R(G_q)$ . . . $X_{255}^R(G_q)$) corresponding to the 256 gray scales at the second transition brightness adjustment value (170 nits) are sequentially calculated, so as to obtain the transition gamma band corresponding to the second transition brightness adjustment value (170 nits).

In this way, according to the order of the brightness adjustment values from small to large, the gamma bands corresponding to the first transition brightness adjustment value (130 nits) and the second transition brightness adjustment value (170 nits) that are between the two reference brightness adjustment values corresponding to the reference point B and the reference point C are sequentially obtained. Therefore, the transition point p and transition point q are obtained. A manner of arranging the transition points between another two adjacent reference points may refer to the above arrangement.

Figure 14B:
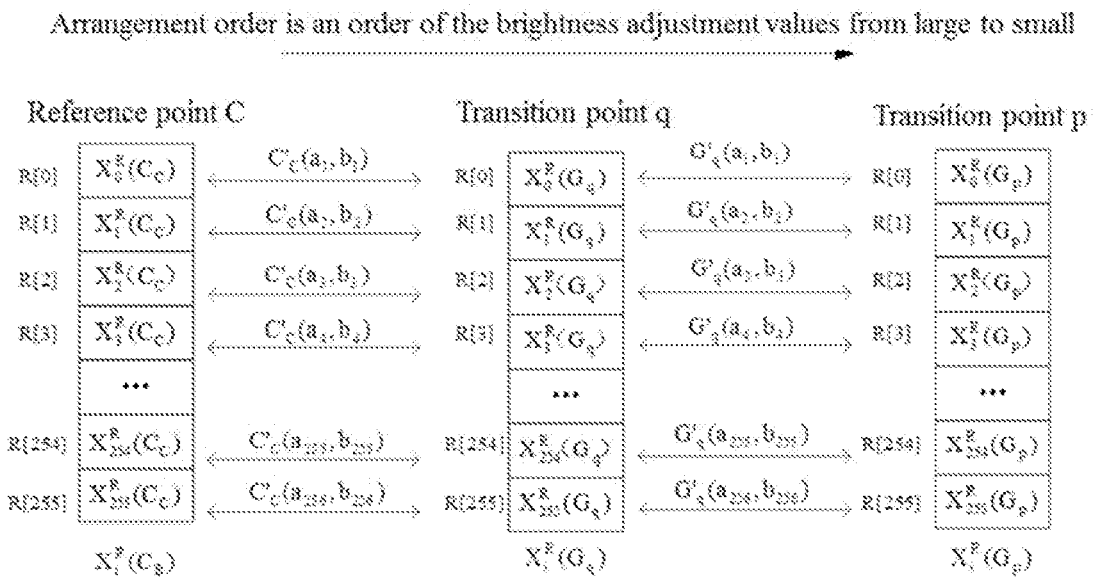
FIG. 14*b* is another schematic diagram of a corresponding relationship of register values of a gamma correction method, in accordance with some embodiments of the present disclosure.

With reference to FIG. 14*b*, red is taken as an example; in a case where the number of the gray scales of the display screen to be debugged is 256, the specific steps of S222' will be exemplarily described.

In a case where the transition gamma band corresponding to each of the at least one transition brightness adjustment value is sequentially calculated according to the order of the transition brightness adjustment values from large to small:

In S222', with respect to the second transition brightness adjustment value (170 nits), the determined point is the reference point C.

At the third reference brightness adjustment value (200 nits) corresponding to the reference point C, in the corresponding gamma curve, the red register values corresponding to the gray scales of 0 to 255 are $X_0^R(C_C)$, $X_1^R(C_C)$, $X_2^R(C_C)$ . . . $X_{255}^R(C_C)$.

The second transition brightness adjustment value (170 nits) corresponds to the transition point q to be arranged. At the second transition brightness adjustment value (170 nits), the red register values $X_0^R(G_q)$, $X_1^R(G_q)$, $X_2^R(G_q)$ . . . $X_{255}^R(G_q)$ corresponding to the gray scales from 0 to 255 need to be calculated.

With respect to the reference point C and the transition point q to be arranged, at a same gray scale, there is a corresponding relationship between the red register values. For example, there is a corresponding relationship between the red register value $X_0^R(C_C)$ and the red register value $X_0^R(G_q)$ both corresponding to 0 gray scale, and the corresponding relationship is referred to as the debugging parameter $C'_C(a_1, b_1)$ of the red register values corresponding to the 0 gray scale at the reference point C. The debugging parameter includes the coefficient $a_1$ and the gain $b_1$ of the red register values corresponding to the 0 gray scale. There is a corresponding relationship between the red register value $X_1^R(C_C)$ and the red register value $X_1^R(G_q)$ corresponding to 1 gray scale, and the corresponding relationship is referred to as the debugging parameter $C'_C(a_2, b_2)$ of the red register values corresponding to 1 gray scale at the reference point C. The debugging parameter includes the coefficient $a_2$ and the gain $b_2$ of the red register values corresponding to the 1 gray scale. Similarly, a set of debugging parameters of the red register values corresponding to the gray scales is the debugging parameter group $C'_C(a_i, b_i)$ corresponding to reference point C, and i is equal to 1 to n.

According to the gamma band corresponding to the reference point C and the debugging parameter group $C'_C(a_i, b_i)$ corresponding to the reference point C, the transition gamma band corresponding to the second transition brightness adjustment value (170 nits) is calculated, and the specific steps are as follows.

Denote i is equal to 1, and the red register value $X_0^R(C_C)$ corresponding to the first gray scale (0 gray scale) is found out from the gamma band corresponding to the reference point C.

The debugging parameter $C'_C(a_1, b_1)$ of the red register value $X_0^R(C_C)$ corresponding to the first gray scale (0 gray scale) is found out from the found debugging parameter group.

According to the equation $X'_i=a_i \times X_i+b_i$, the red register value $X_0^R(G_q)$ corresponding to the first gray scale (0 gray scale) at the second transition brightness adjustment value (170 nits) is calculated.

Denote i is equal to 2, and the red register value $X_1^R(C_C)$ corresponding to the second gray scale (1 gray scale) is found out from the gamma band corresponding to the reference point C.

The debugging parameter $C'_C(a_2, b_2)$ of the red register value $X_1^R(C_C)$ corresponding to the second gray scale (1 gray scale) is found out from the found debugging parameter group.

According to the equation $X'_i=a_i \times X_i+b_i$, the red register value $X_1^R(G_q)$ corresponding to the second gray scale (1 gray scale) at the second transition brightness adjustment value (170 nits) is calculated.

Denote i is equal to i+1, and the above steps are repeated until i is greater than 256. The red register values $X_0^R(G_q)$, $X_1^R(G_q)$, $X_2^R(G_q)$ . . . $X_{255}^R(G_q)$) corresponding to the 256 gray scales at the second transition brightness adjustment value (170 nits) are sequentially calculated, so as to obtain the transition gamma band corresponding to the second transition brightness adjustment value (170 nits).

After the transition gamma band corresponding to the second transition brightness adjustment value (170 nits) is obtained, the transition gamma band corresponding to the first transition brightness adjustment value (130 nits) is then calculated.

In S222', for the first transition brightness adjustment value (130 nits), the determined point is the transition point q.

At the second transition brightness adjustment value (170 nits) corresponding to the transition point q, in the corresponding gamma curve, the red register values corresponding to the gray scales of 0 to 255 are $X_0^R(G_q)$, $X_1^R(G_q)$, $X_2^R(G_q)$ . . . $X_{255}^R(G_q)$.

The first transition brightness adjustment value corresponds to the transition point p to be arranged. At the first transition brightness adjustment value (130 nits), the red register values $X_0^R(G_p)$, $X_1^R(G_p)$, $X_2^R(G_p)$ . . . $X_{255}^R(G_p)$ corresponding to the gray scales from 0 to 255 need to be calculated.

With respect to the transition point q and the transition point p to be arranged, at a same gray scale, there is a corresponding relationship between the red register values. A set of debugging parameters of the red register values corresponding to the gray scales is the debugging parameter group $G'_q(a_i, b_i)$ corresponding to the transition point q, and i is equal to 1 to n.

According to the gamma band corresponding to the transition point q and the debugging parameter group $G_q(a_i, b_i)$ corresponding to the transition point q, the transition gamma band corresponding to the first transition brightness adjustment value (130 nits) is calculated, and the specific steps are as follows.

Denote i is equal to 1, and the red register value $X_0^R(G_q)$ corresponding to the first gray scale (0 gray scale) is found out from the gamma band corresponding to the transition point q.

The debugging parameter $G'_q(a_1, b_1)$ of the red register value $X_0^R(G_q)$ corresponding to the first gray scale (0 gray scale) is found out from the found debugging parameter group.

According to the equation $X'_i=a_i \times X_i+b_i$, the red register value $X_0^R(G_p)$ corresponding to the first gray scale (0 gray scale) at the first transition brightness adjustment value (130 nits) is calculated.

Denote i is equal to 2, and the red register value $X_1^R(G_q)$ corresponding to the second gray scale (1 gray scale) is found out from the gamma band corresponding to the transition point q.

The debugging parameter $G'_q(a_2, b_2)$ of the red register value $X_1^R(G_q)$ corresponding to the second gray scale (1 gray scale) is found out from the found debugging parameter group.

According to the equation $X'_i=a_i \times X_i+b_i$, the red register value $X_1^R(G_p)$ corresponding to the second gray scale (1 gray scale) at the first transition brightness adjustment value (130 nits) is calculated.

Denote i is equal to i+1, and the above steps are repeated until i is greater than 256. The red register values $X_0^R(G_p)$, $X_1^R(G_p)$, $X_2^R(G_p)$ . . . $X_{255}^R(G_p)$) corresponding to the 256 gray scales at the first transition brightness adjustment value are sequentially calculated, so as to obtain the transition gamma band corresponding to the first transition brightness adjustment value (130 nits).

In this way, according to the order of the brightness adjustment values from large to small, the gamma bands corresponding to the second transition brightness adjustment value (170 nits) and the first transition brightness adjustment value (130 nits) that are between the two reference brightness adjustment values corresponding to the reference point B and the reference point C are sequentially obtained. Therefore, the transition point p and transition point q are obtained. The manner of arranging the transition points between another two adjacent reference points may refer to the above arrangement.

Figure 15:
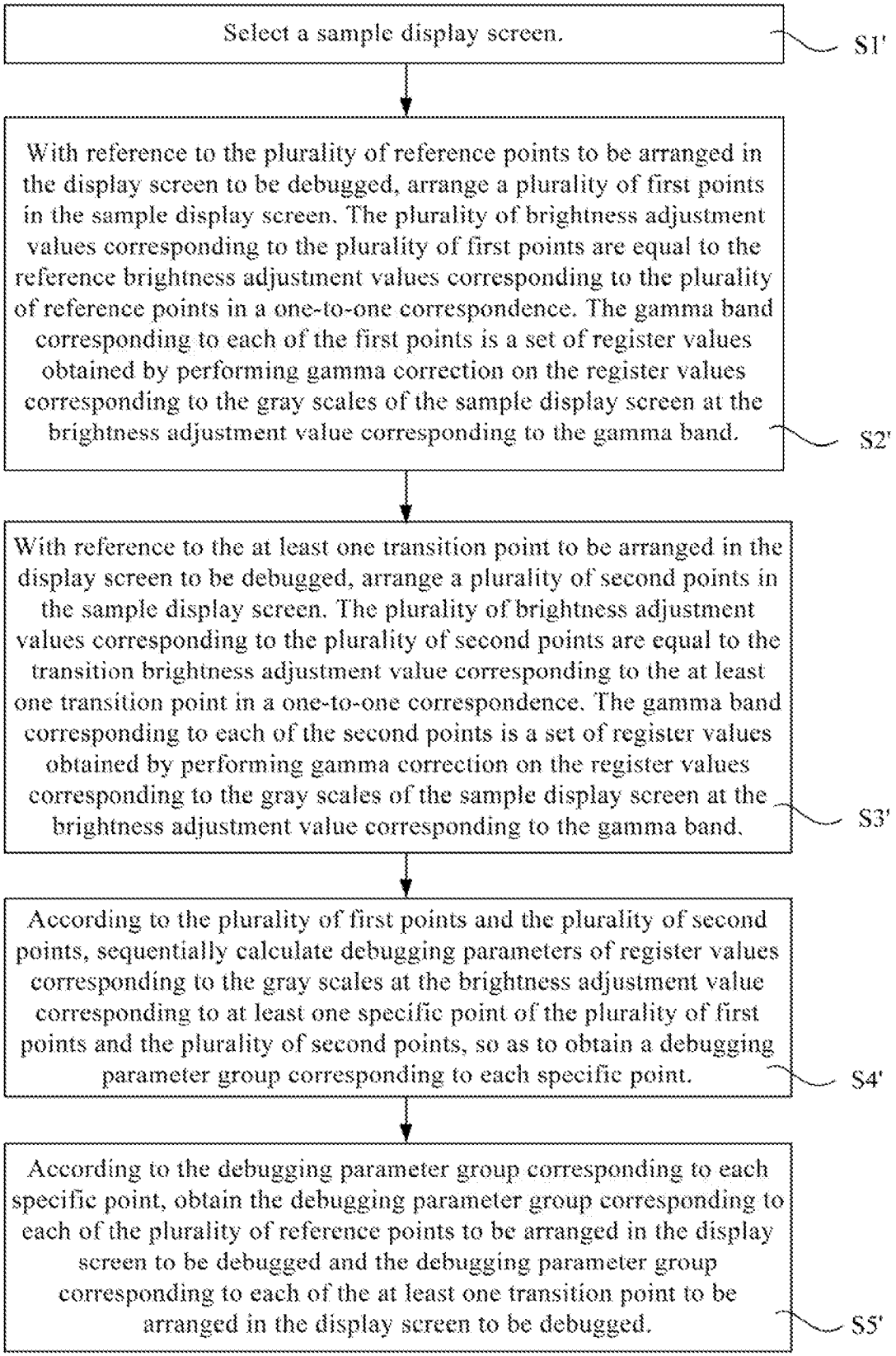
FIG. 15 is yet another flow diagram of a gamma correction method, in accordance with some embodiments of the present disclosure.

In some embodiments, the gamma correction method further includes the step of obtaining a debugging parameter group corresponding to each of the plurality of reference points, and a debugging parameter group corresponding to each of the at least one transition point. As shown in FIG. 15, the step includes the following processes.

S1': a sample display screen is selected.

S2': with reference to the plurality of reference points to be arranged in the display screen to be debugged, a plurality of first points are arranged in the sample display screen. The plurality of brightness adjustment values corresponding to the plurality of first points are equal to the reference brightness adjustment values corresponding to the plurality of reference points in a one-to-one correspondence. The gamma band corresponding to each of the first points is a set of register values obtained by performing gamma correction on the register values corresponding to the gray scales of the sample display screen at the brightness adjustment value corresponding to the gamma band.

Figure 16:
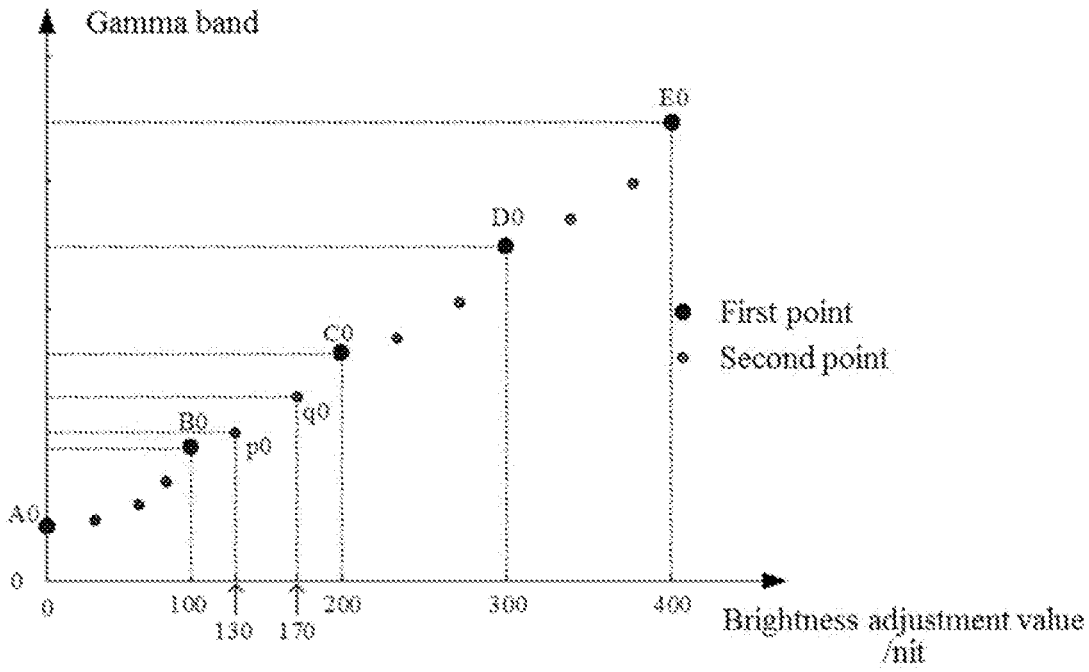
FIG. 16 is a schematic diagram of points obtained through performing a gamma correction on a sample display screen by using the gamma correction method, in accordance with some embodiments of the present disclosure.

With reference to FIG. 9 and FIG. 16, for example, the reference brightness adjustment values corresponding to the plurality of reference points are 0 nit, 100 nits, 200 nits, 300 nits and 400 nits. Therefore, the brightness adjustment values corresponding to the plurality of first points arranged in the sample display screen are 0 nit, 100 nits, 200 nits, 300 nits and 400 nits, and the plurality of first points are a first point A0, a first point B0, a first point C0, a first point D0 and a first point E0.

The gamma band corresponding to the first point A0 with a brightness adjustment value of 0 nit is: a set of register values obtained by performing the gamma correction on the register values corresponding to the gray scales of the sample display screen at the brightness adjustment value of 0 nit to make the gamma value of the gamma curve at the brightness adjustment value conform to 2.2+0.2 to 2.2−0.2 (2.2±0.2). The gamma bands corresponding to other first points may be referred to the above description, which will not be described in detail herein again.

It will be noted that in the sample display screen, after performing the gamma correction, the gamma band corresponding to each of the plurality of first points is known and stored in the sample display screen. That is, the sample display screen stores a set of register values corresponding to the gray scales at the brightness adjustment value corresponding to each of the plurality of first points.

S3': with reference to the at least one transition point to be arranged in the display screen to be debugged, a plurality of second points are arranged in the sample display screen. The plurality of brightness adjustment values corresponding to the plurality of second points are equal to at least one transition brightness adjustment value corresponding to the at least one transition point in a one-to-one correspondence. The gamma band corresponding to each of the second points is a set of register values obtained by performing gamma correction on the register values corresponding to the gray scales of the sample display screen at the brightness adjustment value corresponding to the gamma band.

With reference to FIG. 9 and FIG. 16, for example, the arrangement manner of the at least one transition point is that a transition point p and a transition point q are disposed between the reference point B and the reference point C, and two transition brightness adjustment values corresponding to the two transition points are 130 nits and 170 nits. In this step, the plurality of brightness adjustment values of the arranged second points are 130 nits and 170 nits. Correspondingly, the two second points are a second point p0 and a second point q0.

The gamma band corresponding to the second point p0 with the brightness adjustment value of 130 nits is: a set of register values obtained by performing the gamma correction on the register values corresponding to the gray scales of the sample display screen at the brightness adjustment value of 130 nits to make the gamma value of the gamma curve at the brightness adjustment value conform to 2.2+0.2 to 2.2−0.2 (2.2±0.2). The gamma band corresponding to the second point q0 at the brightness adjustment value of 170 nits may be referred to the above description, which will not be described in detail herein again.

It will be noted that in the sample display screen, after performing the gamma correction, the gamma band corresponding to each of the plurality of second points is known and stored in the sample display screen. That is, the sample display screen stores a set of register values corresponding to the gray scales at the brightness adjustment value corresponding to each of the plurality of second points.

S4': according to the plurality of first points and the plurality of second points, at the brightness adjustment value corresponding to at least one specific point of the plurality of first points and the plurality of second points, debugging parameters of register values corresponding to the gray scales are sequentially calculated, so as to obtain a debugging parameter group corresponding to each specific point. Herein, the at least one specific point is a point adjacent to each second point and located before the corresponding second point according to an arrangement order of the brightness adjustment values; the arrangement order of the brightness adjustment values is the order of the brightness adjustment values from small to large, or the order of the brightness adjustment values from large to small.

In the above steps, for example, in a case where the arrangement order of the brightness adjustment values is in the order of the brightness adjustment values from small to large, with respect to the second point p0, a point adjacent to the second point p0 and located before the second point p0 in the order of the brightness adjustment values from small to large is the first point B0, and the first point B0 is a specific point relative to the second point p0. The debugging parameters of the register values corresponding to the gray scales at the brightness adjustment value of 100 nits corresponding to the first point B0 are calculated, so as to obtain the debugging parameter group corresponding to the first point B0.

With respect to the second point q0, a point adjacent to the second point q0 and located before the second point q0 in the order of the brightness adjustment values from small to large is the second point p0, and the second point p0 is a specific point relative to the second point q0. The debugging parameters of the register values corresponding to the gray scales at the brightness adjustment value of 130 nits corresponding to the second point p0 are calculated, so as to obtain the debugging parameter group corresponding to the second point p0.

For example, in a case where the arrangement order of the brightness adjustment values is in the order of the brightness adjustment values from large to small, with respect to the second point q0, a point adjacent to the second point q0 and located before the second point q0 in the order of the brightness adjustment values from large to small is the first point C0, and the first point C0 is a specific point relative to the second point q0. The debugging parameters of the register values corresponding to the gray scales at the brightness adjustment value of 200 nits corresponding to the first point C0 are calculated, so as to obtain the debugging parameter group corresponding to the first point C0.

With respect to the second point p0, a point adjacent to the second point p0 and located before the second point p0 in the order of the brightness adjustment values from large to small is the second point q0, and the second point q0 is a specific point relative to the second point p0. The debugging parameters of the register values corresponding to the gray scales at the brightness adjustment value of 170 nits corresponding to the second point q0 are calculated, so as to obtain the debugging parameter group corresponding to the second point q0.

S5': according to the debugging parameter group corresponding to each specific point, the debugging parameter group corresponding to each of the plurality of reference points to be arranged in the display screen to be debugged is obtained, and the debugging parameter group corresponding to each of the at least one transition point to be arranged in the display screen to be debugged is obtained.

In the above steps, for example, in a case where the arrangement order of the brightness adjustment values is in the order of the brightness adjustment values from small to large, with respect to the second point p0, the first point B0 is a specific point relative to the second point p0, and the specific point (the first point B0) corresponds to the reference point B in the display screen to be debugged. Therefore, the obtained debugging parameter group corresponding to the first point B0 is the debugging parameter group corresponding to the reference point B in the display screen to be debugged.

With respect to the second point q0, the second point p0 is a specific point relative to the second point q0, and the specific point (the second point p0) corresponds to the transition point p in the display screen to be debugged. Therefore, the obtained debugging parameter group corresponding to the second point p0 is the debugging parameter group corresponding to the transition point p in the display screen to be debugged.

For example, in a case where the arrangement order of the brightness adjustment values is in the order of the brightness adjustment values from large to small, with respect to the second point q0, the first point C0 is a specific point relative to the second point q0, and the specific point (the first point C0) corresponds to the reference point C in the display screen to be debugged. Therefore, the debugging parameter group corresponding to the first point C0 is the debugging parameter group corresponding to the reference point C in the display screen to be debugged.

With respect to the second point p0, the second point q0 is a specific point relative to the second point p0, and the specific point (the second point q0) corresponds to the transition point q in the display screen to be debugged. Therefore, the obtained debugging parameter group corresponding to the second point q0 is the debugging parameter group corresponding to the transition point q in the display screen to be debugged.

That is, each specific point in the sample display screen corresponds to one of the reference points or the transition point(s) to be arranged in the display screen to be debugged. Therefore, the debugging parameter group corresponding to each specific point is the debugging parameter group of one of the reference points or the transition point(s) to be arranged in the display screen to be debugged corresponding to the specific point in a one-to-one correspondence.

Figure 17:
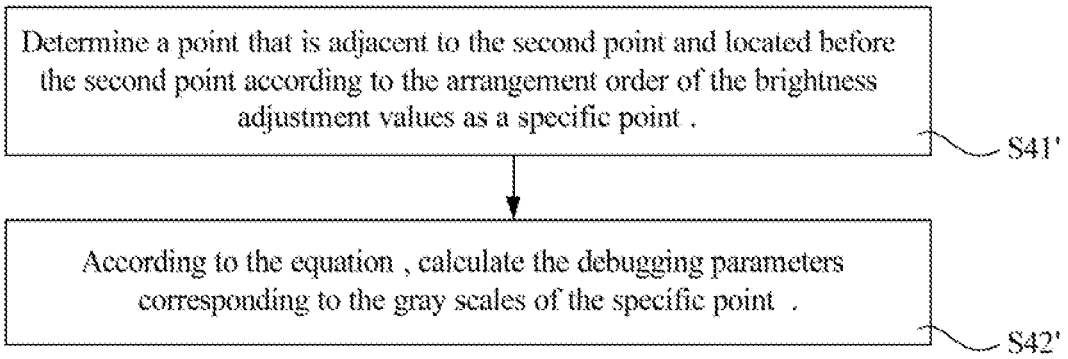
FIG. 17 is yet another flow diagram of a gamma correction method, in accordance with some embodiments of the present disclosure.

In some embodiments, as shown in FIG. 17, according to the plurality of first points and the plurality of second points, at the brightness adjustment value corresponding to at least one specific point of the plurality of first points and the plurality of second points, debugging parameters of the register values corresponding to the gray scales are sequentially calculated; the above step includes the following processes.

With respect to each second point,

S41': a point that is adjacent to the second point and located before the second point according to the arrangement order of the brightness adjustment values is determined as a specific point.

For example, in a case where the arrangement order of the brightness adjustment values is in the order of the brightness adjustment values from small to large, with respect to the second point p0, a point adjacent to the second point p0 and located before the second point p0 in the order of the brightness adjustment values from small to large is the first point B0, and the first point B0 is a specific point relative to the second point p0.

With respect to the second point q0, a point adjacent to the second point q0 and located before the second point q0 in the order of the brightness adjustment values from small to large is the second point p0, and the second point p0 is a specific point relative to the second point q0.

S42': according to the equation $X'_{0i}=a_i \times X_{0i}+b_i$, the debugging parameters corresponding to the gray scales of the specific point are calculated.

Herein, $X'_{0i}$ represents the register value corresponding to the $i^{th}$ gray scale of the second point; $X_{0i}$ represents the register value corresponding to the $i^{th}$ gray scale of the specific point; $a_i$ represents the coefficient corresponding to the $i^{th}$ gray scale of the specific point, and $b_i$ represents the gain corresponding to the $i^{th}$ gray scale of the specific point.

For example, the arrangement order of the brightness adjustment values is the order of the brightness adjustment values from small to large, and red is taken as an example; according to the second point p0 and the specific point (the first point B0) relative to the second point p0, a detailed introduction to S42' is as follows.

It will be noted that the set of red register values $X_0^R(C_{B0})$, $X_1^R(C_{B0})$, $X_2^R(C_{B0})$ . . . $X_{255}^R(C_{B0})$ corresponding to the gray scales at the brightness adjustment value (100 nits) corresponding to the first point B0, and the set of the red register values $X_0^R(G_{p0})$, $X_1^R(G_{p0})$, $X_2^R(G_{p0})$ . . . $X_{255}^R$ ($G_{p0}$) corresponding to the gray scales at the brightness adjustment value (130 nits) corresponding to the second point p0 are all known and stored in the sample display screen. The process of calculating the debugging parameters corresponding to the gray scales of the first point B0 is the process of establishing the corresponding relationship between the register value of the first point B0 and the register value of the second point p0 at the same gray scale. The process of establishing the corresponding relationship is according to the equation $X'_{0i}=a_i \times X_{0i}+b_i$, and the debugging parameters corresponding to the gray scales of the first point B0 are calculated.

Herein, $X'_{0i}$ represents the register value corresponding to the $i^{th}$ gray scale of the second point p0; $X_{0i}$ represents the register value corresponding to the $i^{th}$ gray scale of the first point B0; $a_i$ represents the coefficient corresponding to the $i^{th}$ gray scale of the first point B0, and $b_i$ represents the gain corresponding to the $i^{th}$ gray scale of the first point B0.

For example, a way to establish the corresponding relationship between the red register value $X_0^R(C_{B0})$ and the red register value $X_0^R(G_{p0})$ both corresponding to 0 gray scale is that: according to the red register value $X_0^R(C_{B0})$ corresponding to 0 gray scale of the first point B0, and the red register value $X_0^R(G_{p0})$ corresponding to the 0 gray scale of the second point p0, the coefficient $a_1$ is set first, and then according to the equation $X'_{0i}=a_i \times X_{0i}+b_i$ (i.e., $X_0^R(G_{p0})=a_1 \times X_0^R(C_{B0})+b_1$, where $X_0^R(G_{p0})$, $X_0^R(C_{B0})$, $a_1$ are known quantities), the gain $b_1$ is obtained by calculation, so as to obtain the debugging parameter $C_{B0}(a_1, b_1)$ of the red register value corresponding to the 0 gray scale of the first point B0.

The way to establish the corresponding relationship between the red register value $X_1^R(C_{B0})$ and the red register value $X_1^R(G_{p0})$ both corresponding to 1 gray scale is that: according to the red register value $X_1^R(C_{B0})$ corresponding to 1 gray scale of the first point B0, and the red register value $X_1^R(G_{p0})$ corresponding to the 1 gray scale of the second point p0, the coefficient $a_2$ is set first, and then according to the equation $X'_{0i}=a_i \times X_{0i}+b_i$ (i.e., $X_1^R(G_{p0})=a_2 \times X_1^R(C_{B0})+b_2$, where) $X_1^R(C_{B0})$, $X_1^R(G_{p0})$, $a_2$ are known quantities), the gain $b_2$ is obtained by calculation, so as to obtain the debugging parameter $C_{B0}(a_2, b_2)$ of the red register value corresponding to the 1 gray scale of the first point B0.

The establishment of the debugging parameters of the register values corresponding to other gray scales of the first point B0 may be referred to the above description, and details are not described herein again.

In this way, through the above method, the debugging parameters of the red register values corresponding to the gray scales of the first point B0 are calculated. The set of the debugging parameters of the red register values corresponding to the gray scales of the first point B0 is the debugging parameter group $C_{B0}(a_i, b_i)$ corresponding to the first point B0, and i is equal to 1 to n. It will be noted that the debugging parameter group $C_{B0}(a_i, b_i)$ corresponding to the first point B0 established in the sample display screen is the debugging parameter group $C_B(a_i, b_i)$ corresponding to the reference point B in the display screen to be debugged.

Similarly, the second point p0 is a specific point relative to the second point q0. Through the above steps, the corresponding relationship between the second point p0 and the second point q0 is established, and the debugging parameters corresponding to the gray scales of the second point p0 may be obtained. The set of debugging parameters of the register values corresponding to the gray scales of the second point p0 is the debugging parameter group $G_{p0}(a_i, b_i)$ corresponding to the second point p0, and i is equal to 1 to n. It will be noted that the debugging parameter group $G_{p0}(a_i, b_i)$ corresponding to the second point p0 established in the sample display screen is the debugging parameter group $G_p(a_i, b_i)$ corresponding to the transition point p in the display screen to be debugged.

In a case where the arrangement order of the brightness adjustment values is the order of the brightness adjustment values from large to small, in S42', according to the equation $X'_{0i}=a_i \times X_{0i}+b_i$, the step of calculating the debugging parameters corresponding to the gray scales of the specific point may be referred to the above example steps where the arrangement order of the brightness adjustment values is in the order of the brightness adjustment values from small to large.

In some embodiments, the gamma correction method further includes that the established corresponding relationship between the point and the debugging parameters is prestored in the display screen to be debugged.

The corresponding relationship between the point and the debugging parameters established by the selected sample display screen is prestored in the display screen to be debugged, so that the corresponding relationship is invoked when the relevant steps (such as S221 and S222, or S221' and S222') in the gamma correction method provided by the embodiments of the disclosure are implemented on the display screen to be debugged.

In some embodiments, the obtained debugging parameter group corresponding to each of the plurality of reference points and the obtained debugging parameter group corresponding to each of the at least one transition point are prestored in the display screen to be debugged.

It will be noted that, the material, structure and integrated circuit (IC) of the display screens in a same production batch are the same. Therefore, display parameters of the display screens in the same production batch are substantially the same. In this way, the debugging parameter group corresponding to each first point and the debugging parameter group corresponding to each second point that are established according to the selected sample display screen may correspond to the debugging parameter group corresponding to each reference point and the debugging parameter group corresponding to each transition point in the display screen to be debugged, so as to ensure the accuracy of the gamma correction algorithm.

In some embodiments, the reference brightness adjustment values corresponding to two adjacent reference points and the transition brightness adjustment value corresponding to the at least one transition point form an arithmetic progression.

In the above embodiments, the transition brightness adjustment value is obtained in a way that the brightness adjustment range between the brightness adjustment values corresponding to two adjacent reference points is equally divided, and the brightness adjustment value corresponding to the division point is selected as the transition brightness adjustment value. For example, three brightness adjustment values are selected as the transition brightness adjustment values between the reference brightness adjustment value of 100 nits corresponding to the second reference point B and the reference brightness adjustment value of 200 nits corresponding to the reference point C, and the three brightness adjustment values are 125 nits, 150 nits and 175 nits, respectively. In this way, the at least one transition point disposed between two adjacent reference points is evenly distributed. In a case where the brightness adjustment curve that represents the corresponding relationship between the brightness adjustment values and the gamma bands is obtained according to the plurality of the reference points and the plurality of transition points, the obtained brightness adjustment curve is more in line with the characteristics of the light-emitting materials of the OLED display device, so as to make the displayed images better when the brightness of the OLED display device is adjusted.

In some embodiments, the number of the transition points arranged between two adjacent reference points is at least two.

The greater the number of the transition points arranged between two adjacent reference points is, the more specific points that represent the corresponding relationship between the brightness adjustment value and the gamma band are. When the brightness adjustment curve is obtained, according to the plurality of reference points and the plurality of transition points, the obtained brightness adjustment curve may be more in line with the characteristic change of the light-emitting materials of the display screen, thereby improving the display effect of the display screen.

In some embodiments, the step of arranging at least one transition point between two adjacent reference points includes arranging at least one transition point between every two adjacent reference points.

For example, at least one transition point is arranged between the reference point A and the reference point B, between the reference point B and the reference point C, between the reference point C and the reference point D, between the reference point D and the reference point E. In this way, the accuracy of the gamma correction algorithm may be improved. It may be ensured that in the entire brightness adjustment value range, when the brightness adjustment of the display screen is performed according to the obtained brightness adjustment curve, the poor display phenomenon, such as being reddish or greenish at the brightness adjustment values between the reference brightness adjustment values, may be effectively improved.

Figure 18:
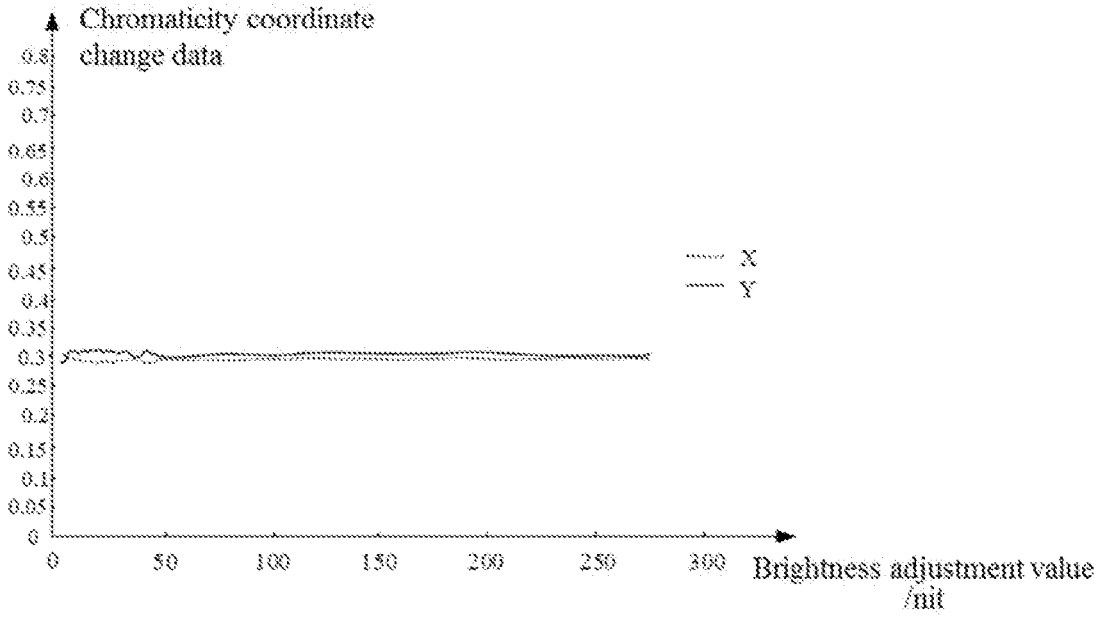
FIG. 18 is another schematic diagram of a chromaticity coordinate change curve in a brightness adjustment value range from 0 nit to 300 nits, in accordance with some embodiments of the present disclosure.

In a case where one transition point is disposed between every two adjacent reference points, as shown in FIG. 18, FIG. 18 shows the chromaticity coordinate change curve in the brightness adjustment value range from 0 nit to 300 nits, where X represents the horizontal axis in the chromaticity coordinate, and Y represents the vertical axis in the chromaticity coordinate. It may be seen that in the entire brightness adjustment value range, the value of the horizontal axis X is substantially the same as the value of the vertical axis Y, and both are approximately 0.3. The color displayed in the chromaticity coordinate is white, indicating that the attenuation speed of green pixels is substantially the same as the attenuation speed of red pixels, so that the displayed images will not be reddish or greenish, thereby improving the display effect of the display device.

In some embodiments, among the plurality of reference brightness adjustment values corresponding to the plurality of reference points, a brightness value adjustment range is determined according to the smallest reference brightness adjustment value and the largest reference brightness adjustment value. The brightness value adjustment range includes a first section and a second section, and a brightness adjustment upper limit value of the first section is not greater than a brightness adjustment lower limit value of the second section. The number of transition points corresponding to the first section is greater than the number of transition points corresponding to the second section.

For example, in the plurality of reference brightness adjustment values corresponding to the plurality of reference points, the smallest reference brightness adjustment value of 0 nit and the largest reference brightness adjustment value of 400 nits determine a brightness value adjustment range from 0 nits to 400 nits. The brightness value adjustment range of 0 nit to 400 nits includes the first section of 0 nit to 200 nits and the second section of 200 nits to 400 nits. The brightness adjustment upper limit value of the first section (200 nits) is equal to the brightness adjustment lower limit value of the second section (200 nits).

The number of transition points corresponding to the first section of 0 nit to 200 nits is greater than the number of transition points corresponding to the second section of 200 nits to 400 nits. For example, three transition points are disposed between every two adjacent reference points in the first section, and one transition point is disposed between every two adjacent transition points in the second section.

Since the gamma bands corresponding to the plurality of brightness adjustment values are obtained through linear interpolation between two adjacent transition points in the related art, at low brightness adjustment values, at the brightness adjustment values between the reference brightness adjustment values, the display images will have a poor display phenomenon, such as being reddish or greenish. Therefore, the number of transition points disposed in the lower brightness adjustment value range is greater than the number of transition points disposed in the higher brightness adjustment value range, so that the poor display phenomenon that occur at the low brightness adjustment values may be effectively improved. And it may be ensured that the display effect at high brightness adjustment values is not affected; meanwhile, the workload of providing a plurality of transition points in the display screen to be debugged, and providing a plurality of second points in the sample display screen and calculating the debugging parameter groups may be reduced, thereby saving time and improving efficiency.

In some embodiments, the number of transition points arranged between every two adjacent reference points of the first section is greater than the number of transition points arranged between every two adjacent reference points of the second section.

For example, three transition points are arranged between every two adjacent reference points in the first section of 0 nit to 200 nits, and two transition points are arranged between every two adjacent reference points in the second section of 200 nits to 400 nits. In this way, it not only may effectively improve the poor display phenomenon, such as the displayed images being reddish or greenish that occurs at the low brightness adjustment values, but also save the workload and improve the efficiency of gamma correction.

In some embodiments, the display screen to be debugged may display at least two colors. With respect to the establishment of the brightness adjustment curve of each color, the gamma correction method described above is performed. For example, in a case where the display screen to be debugged displays three colors, such as red, blue, and green, with respect to the establishment of the brightness adjustment curve of red, the establishment of the brightness adjustment curve of blue, and the establishment of the brightness adjustment curve of green, the gamma correction method described above is performed to each of which.

Since the light-emitting material of each color has its own characteristics, such as the attenuation speed, with respect to the establishment of the brightness adjustment curve of each color, the gamma correction method described above is performed. In this way, the brightness adjustment curve obtained by using the gamma correction method is in line with the characteristics of the light-emitting material, so that at each brightness adjustment value, the display effect of the images displayed on the display screen is better, and will not be reddish or greenish.

The various embodiments described herein may be implemented by using a computer-readable storage medium such as a computer software, a hardware, or any combination thereof.

With respect to the hardware implementation, the embodiments described herein may be implemented by using at least one of an application-specific integrated circuit (ASIC), a digital signal processor (DSP), a digital signal processing device (DSPD), a programmable logic device (PLD), a field programmable gate array (FPGA), a processor, a controller, a microcontroller, a microprocessor, and an electronic unit designed to perform the functions described herein. In some cases, such an implementation may be implemented in a processor unit.

With respect to the software implementation, embodiments such as procedures or functions may be implemented with an individual software module that allows to implement at least one function or operation. The software code may be implemented by a software application (or program) written in any appropriate programming language, and the software code may be stored in a memory and be executed by a processor unit.

Figure 19:
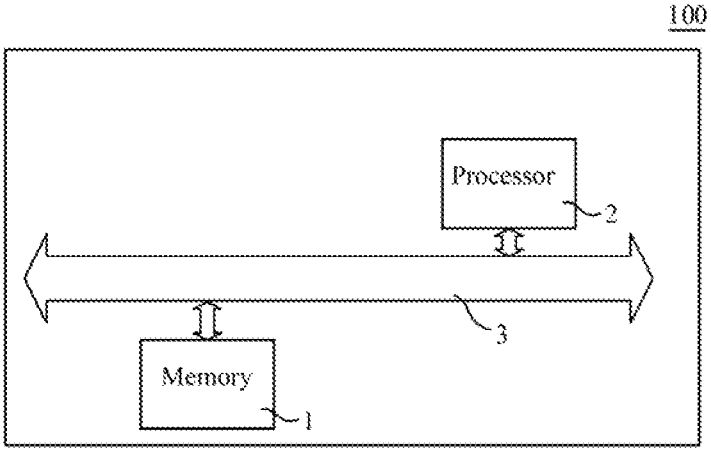
FIG. 19 is a schematic diagram of a gamma correction device, in accordance with some embodiments of the present disclosure.

As shown in FIG. 19, some embodiments of the present disclosure provide a gamma correction device 100 including a memory 1 and a processor 2. The memory 1 stores a computer instruction, and the processor 2 is configured to read and execute the computer instruction, so as to achieve one or more steps in the gamma correction method according to the embodiments of the present disclosure.

The gamma correction device 100 is used to perform gamma correction on the display screen to be debugged. Through the gamma correction device, at low brightness adjustment values, the poor display phenomenon, such as the displayed images being reddish or greenish that occurs at the brightness adjustment values between the reference brightness adjustment values, may be improved, and the display effect of the display screen may be improved.

For example, the memory 1 in the embodiments of the present disclosure may include a read-only memory and a random access memory.

For example, the processor 2 in the embodiments of the present disclosure may be a central processing unit (CPU), or may be other general-purpose processors, a digital signal processor (DSP), an application specific integrated circuit (ASIC), a field programmable gate array (FPGA), or other programmable logic devices, a discrete gate or transistor logic device, a discrete hardware component, etc. The general-purpose processors may be a microprocessor or any conventional processors or the like.

It will be understood that the memory 1 and the processor 2 in the embodiments of the present disclosure may interact through a communication bus 3. In addition to a data bus, the communication bus may also include a power bus, a control bus, and a status signal bus. However, to be clear, the various buses are marked as the communication bus in the drawing.

Figure 20:
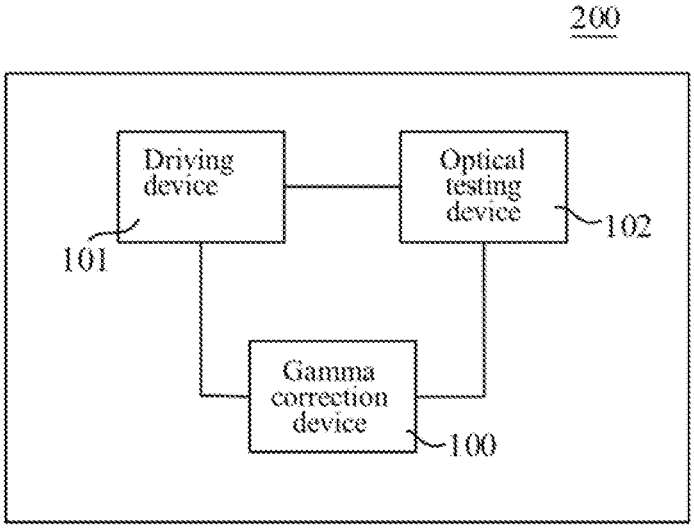
FIG. 20 is a schematic diagram of a gamma correction system, in accordance with some embodiments of the present disclosure.

As shown in FIG. 20, some embodiments of the present disclosure provide a gamma correction system 200. The gamma correction system 200 includes the gamma correction device 100, a driving device 101, and an optical testing device 102.

Herein, the driving device 101 is configured to drive the display screen to be debugged to operate. The optical testing device 102 is configured to sample optical parameters of the display screen to be debugged under the control of the gamma correction device, and upload the sampled optical parameters to the gamma correction device. The gamma correction device 100 performs the gamma correction on the display screen to be debugged according to the optical parameters.

For example, the driving device 101 may be a signal generator providing driving signals to drive a product, which is implemented based on an advanced RISC machine (ARM), or a field programmable gate array (FPGA) in combination with a personal computer (PC), etc.

For example, the optical testing device 102 may be a display image detector or the like.

Some embodiments of the present disclosure provide a computer-readable storage medium. The computer-readable storage medium stores computer instructions that may be run on a processor, and the computer instructions, when executed by the processor, implements one or more steps in the gamma correction method as described above.

It will be noted that the computer-readable storage medium provided by the embodiments of the present disclosure may include, but is not limited to, various media that can store program codes, such as a magnetic storage device (such as a hard disk, a floppy disk, or a magnetic tape), a read-only memory (ROM), a random access memory (RAM), and an erasable programmable read-only memory (EPROM).

Some embodiments of the present disclosure provide a computer program product. When the computer program product runs on a computer, the computer is caused to execute one or more steps in the gamma correction method as described above.

The computer storage media or computer program products provided in the embodiments of the present disclosure are both used to execute the gamma correction method provided above. Therefore, beneficial effects that may be achieved may refer to beneficial effects in the corresponding method provided above, and details will not be repeated herein.

The foregoing descriptions are merely specific implementation manners of the present disclosure, but the protection scope of the present disclosure is not limited thereto. Any changes or replacements that a person skilled in the art could readily conceive of within the technical scope of the present disclosure shall be included in the protection scope of the present disclosure. Therefore, the protection scope of the present disclosure shall be subject to the protection scope of the claims.

What is claimed is:

1. A gamma correction method applied to a display screen to be debugged, comprising: for a color of the display screen to be debugged, arranging a plurality of reference points, wherein each reference point of the plurality of reference points represents a mapping relationship between a reference brightness adjustment value and a reference gamma band, and the plurality of reference points are ranked in an order of reference brightness adjustment values from small to large or from large to small;

arranging at least one transition point between two adjacent reference points, wherein each transition point of the at least one transition point represents a mapping relationship between a transition brightness adjustment value and a transition gamma band; and obtaining a brightness adjustment curve representing a corresponding relationship between brightness adjustment values and gamma bands according to the plurality of reference points and the at least one transition point;

wherein each gamma band represents a set of register values corresponding to gray scales of the color at a brightness adjustment value corresponding to the gamma band; and a step of arranging at least one transition point between two adjacent reference points includes:

selecting at least one brightness adjustment value in a range between reference brightness adjustment values corresponding to the two adjacent reference points as at least one transition brightness adjustment value corresponding to the at least one transition point to be arranged; and according to at least one of the two adjacent reference points, a debugging parameter group corresponding to each reference point of the plurality of reference points, and a debugging parameter group corresponding to each transition point of the at least one transition point, sequentially calculating the transition gamma band corresponding to each transition brightness adjustment value of the at least one transition brightness adjustment value to obtain the at least one transition point;

wherein each debugging parameter group represents a set of debugging parameters of register values corresponding to the gray scales of the color at the brightness adjustment value corresponding to a point in correspondence with the debugging parameter group.

2. The gamma correction method according to claim 1, wherein the step of according to at least one of the two adjacent reference points, a debugging parameter group corresponding to each reference point of the plurality of reference points, and a debugging parameter group corresponding to each transition point of the at least one transition point, sequentially calculating the transition gamma band corresponding to each transition brightness adjustment value of the at least one transition brightness adjustment value to obtain the at least one transition point, includes:

according to an order of the transition brightness adjustment values from small to large, sequentially calculating the transition gamma band corresponding to each transition brightness adjustment value of the at least one transition brightness adjustment value; and for each transition brightness adjustment value, determining a point corresponding to a brightness adjustment value that is adjacent to the transition brightness adjustment value and less than the transition brightness adjustment value; and calculating the transition gamma band corresponding to the transition brightness adjustment value according to a gamma band corresponding to the determined point and a debugging parameter group corresponding to the determined point, so as to obtain the transition point corresponding to the transition brightness adjustment value.

3. The gamma correction method according to claim 2, wherein the debugging parameter group corresponding to the determined point includes debugging parameters of the register values corresponding to the gray scales of the color, and a debugging parameter includes a coefficient a and a gain b of a register value corresponding to the debugging parameter;

the step of calculating the transition gamma band corresponding to the transition brightness adjustment value according to a gamma band corresponding to the determined point and a debugging parameter group corresponding to the determined point, includes:

finding a register value $X_i$ corresponding to an $i^{th}$ gray scale from the gamma band corresponding to the determined point;

finding a debugging parameter ($a_i$, $b_i$) of the register value $X_i$ corresponding to the $i^{th}$ gray scale from the debugging parameter group corresponding to the determined point;

calculating a register value $X'_i$ corresponding to the $i^{th}$ gray scale at the transition brightness adjustment value according to an equation $X'_i=a_i \times X_i+b_i$; and denoting that i is an integer equal to 1 to n, by repeating the above steps, sequentially calculating register values $X'_1$ to $X'_n$ corresponding to n gray scales at the transition brightness adjustment value to obtain the transition gamma band corresponding to the transition brightness adjustment value; where n represents a number of gray scales of the color and is an integer equal to or greater than 1.

4. The gamma correction method according to claim 3, further comprising a step of obtaining the debugging parameter group corresponding to each reference point of the plurality of reference points and the debugging parameter group corresponding to each transition point of the at least one transition point, and the step including:

selecting a sample display screen;

with reference to the plurality of reference points to be arranged in the display screen to be debugged, arranging a plurality of first points in the sample display screen, wherein a plurality of brightness adjustment values corresponding to the plurality of first points are equal to the reference brightness adjustment values corresponding to the plurality of reference points in a one-to-one correspondence;

a gamma band corresponding to each first point of the plurality of first points being a set of register values obtained by performing gamma correction on register values corresponding to gray scales of the sample display screen at a brightness adjustment value corresponding to the gamma band;

with reference to the at least one transition point to be arranged in the display screen to be debugged, arranging a plurality of second points in the sample display screen, wherein a plurality of brightness adjustment values corresponding to the plurality of second points are equal to at least one transition brightness adjustment value corresponding to the at least one transition point in a one-to-one correspondence;

a gamma band corresponding to each second point of the plurality of second points being a set of register values obtained by performing gamma correction on register values corresponding to the gray scales of the sample display screen at a brightness adjustment value corresponding to the gamma band;

according to the plurality of first points and the plurality of second points, sequentially calculating debugging parameters of register values corresponding to the gray scales at a brightness adjustment value corresponding to at least one specific point of the plurality of first points and the plurality of second points, so as to obtain a debugging parameter group corresponding to each specific point; and according to the debugging parameter group corresponding to each specific point, obtaining the debugging parameter group corresponding to each reference point of the plurality of reference points to be arranged in the display screen to be debugged, and obtaining the debugging parameter group corresponding to each transition point of the at least one transition point to be arranged in the display screen to be debugged;

wherein the specific point is a point adjacent to each second point and located before the corresponding second point according to an arrangement order of the brightness adjustment values; the arrangement order of the brightness adjustment values is an order of the brightness adjustment values from small to large, or an order of the brightness adjustment values from large to small.

5. The gamma correction method according to claim 4, the step of according to the plurality of first points and the plurality of second points, sequentially calculating debugging parameters of register values corresponding to the gray scales at a brightness adjustment value corresponding to at least one specific point of the plurality of first points and the plurality of second points, including:

for each second point, determining a point that is adjacent to the second point and located before the second point according to the arrangement order of the brightness adjustment values as a specific point; and calculating debugging parameters corresponding to gray scales of the specific point according to an equation $X'_{0i}=a_i \times X_{0i}+b_i$;

where $X'_{0i}$ represents a register value corresponding to an $i^{th}$ gray scale of the second point; $X_{0i}$ represents a register value corresponding to an $i^{th}$ gray scale of the specific point; $a_i$ represents a coefficient corresponding to the $i^{th}$ gray scale of the specific point, and $b_i$ represents a gain corresponding to the $i^{th}$ gray scale of the specific point.

6. The gamma correction method according to claim 4, further comprising: prestoring the obtained debugging parameter group corresponding to each reference point of the plurality of reference points and the obtained debugging parameter group corresponding to each of the at least one transition point into the display screen to be debugged.

7. The gamma correction method according to claim 4, wherein the sample display screen and the display screen to be debugged are display screens in a same production batch.

8. The gamma correction method according to claim 1, wherein the step of according to at least one of the two adjacent reference points, a debugging parameter group corresponding to each reference point of the plurality of reference points, and a debugging parameter group corresponding to each transition point of the at least one transition point, sequentially calculating the transition gamma band corresponding to each transition brightness adjustment value of the at least one transition brightness adjustment value to obtain the at least one transition point, includes:

according to an order of the transition brightness adjustment values from large to small, sequentially calculating the transition gamma band corresponding to each transition brightness adjustment value of the at least one transition brightness adjustment value; and for each transition brightness adjustment value, determining a point corresponding to a brightness adjustment value that is adjacent to the transition brightness adjustment value and greater than the transition brightness adjustment value; and calculating the transition gamma band corresponding to the transition brightness adjustment value according to a gamma band corresponding to the determined point and a debugging parameter group corresponding to the determined point, so as to obtain the transition point corresponding to the transition brightness adjustment value.

9. The gamma correction method according to claim 8, wherein the debugging parameter group corresponding to the determined point includes debugging parameters of the register values corresponding to the gray scales of the color, and a debugging parameter includes a coefficient a and a gain b of a register value corresponding to the debugging parameter;

the step of calculating the transition gamma band corresponding to the transition brightness adjustment value according to a gamma band corresponding to the determined point and a debugging parameter group corresponding to the determined point, includes:

finding a register value $X_i$ corresponding to an $i^{th}$ gray scale from the gamma band corresponding to the determined point;

finding a debugging parameter ($a_i$, $b_i$) of the register value $X_i$ corresponding to the $i^{th}$ gray scale from the debugging parameter group corresponding to the determined point;

calculating a register value $X'_i$ corresponding to the $i^{th}$ gray scale at the transition brightness adjustment value according to an equation $X'_i=a_i \times X_i+b_i$; and denoting that i is an integer equal to 1 to n, by repeating the above steps, sequentially calculating register values $X'_1$ to $X'_n$ corresponding to n gray scales at the transition brightness adjustment value to obtain the transition gamma band corresponding to the transition brightness adjustment value; where n represents a number of gray scales of the color and is an integer equal to or greater than 1.

10. The gamma correction method according to claim 1, wherein reference brightness adjustment values corresponding to the two adjacent reference points and at least one transition brightness adjustment value corresponding to the at least one transition point form an arithmetic progression.

11. The gamma correction method according to claim 1, wherein the step of arranging at least one transition point between two adjacent reference points includes: arranging at least one transition point between every two adjacent reference points.

12. The gamma correction method according to claim 1, wherein among a plurality of reference brightness adjustment values corresponding to the plurality of reference points, a smallest reference brightness adjustment value and a largest reference brightness adjustment value determine a brightness value adjustment range;

the brightness value adjustment range includes a first section and a second section, and a brightness adjustment upper limit value of the first section is not greater than a brightness adjustment lower limit value of the second section; and a number of transition points corresponding to the first section is greater than a number of transition points corresponding to the second section.

13. The gamma correction method according to claim 12, wherein a number of transition points arranged between every two adjacent reference points in the first section is greater than a number of transition points arranged between every two adjacent reference points in the second section.

14. The gamma correction method according to claim 1, wherein the step of arranging a plurality of reference points includes:

selecting a plurality of brightness adjustment values as a plurality of reference brightness adjustment values corresponding to the plurality of reference points to be arranged; and performing gamma correction on register values of gray scales of the display screen to be debugged at each selected reference brightness adjustment value, so as to obtain the reference gamma band in correspondence with the corresponding reference brightness adjustment value.

15. The gamma correction method according to claim 1, wherein the display screen to be debugged is able to display at least two colors, and for an establishment of the brightness adjustment curve of each color, the gamma correction method according to claim 1 is performed.

16. A gamma correction device, comprising a memory and a processor, wherein the memory stores a computer instruction, and the processor is configured to read and execute the computer instruction, so as to achieve one or more steps in the gamma correction method according to claim 1.

17. A gamma correction system, comprising:

the gamma correction device according to claim 16;

a driving device configured to drive a display screen to be debugged to operate; and an optical testing device configured to sample optical parameters of the display screen to be debugged under control of the gamma correction device, and upload the sampled optical parameters to the gamma correction device.

18. A non-transitory computer-readable storage medium, the non-transitory computer-readable storage medium storing a computer instruction capable of being executed by a processor, and the computer instruction, when executed by the processor, implementing one or more steps in the gamma correction method according to claim 1.

* * * * *